US010812927B2

(12) United States Patent
Ise et al.

(10) Patent No.: US 10,812,927 B2
(45) Date of Patent: Oct. 20, 2020

(54) SPATIAL SOUND GENERATION DEVICE, SPATIAL SOUND GENERATION SYSTEM, SPATIAL SOUND GENERATION METHOD, AND SPATIAL SOUND GENERATION PROGRAM

(71) Applicant: JAPAN SCIENCE AND TECHNOLOGY AGENCY, Kawaguchi-shi, Saitama (JP)

(72) Inventors: Shiro Ise, Tokyo (JP); Yuichi Kitagawa, Kyoto (JP)

(73) Assignee: JAPAN SCIENCE AND TECHNOLOGY AGENCY, Kawaguchi-Shi (JP)

( * ) Notice: Subject to any disclaimer, the term of this patent is extended or adjusted under 35 U.S.C. 154(b) by 0 days.

(21) Appl. No.: 16/341,539

(22) PCT Filed: Oct. 12, 2017

(86) PCT No.: PCT/JP2017/037043
§ 371 (c)(1),
(2) Date: Apr. 12, 2019

(87) PCT Pub. No.: WO2018/070487
PCT Pub. Date: Apr. 19, 2018

(65) Prior Publication Data

US 2019/0373393 A1 Dec. 5, 2019

(30) Foreign Application Priority Data

Oct. 14, 2016 (JP) ..... 2016-203129

(51) Int. Cl.
*H04S 7/00* (2006.01)
*H04R 1/40* (2006.01)
(Continued)

(52) U.S. Cl.
CPC ..... *H04S 7/303* (2013.01); *H04R 1/403* (2013.01); *H04R 3/12* (2013.01); *H04R 5/02* (2013.01);
(Continued)

(58) Field of Classification Search
CPC ... H04R 5/02; H04R 5/04; H04R 3/12; H04R 1/403; H04R 2201/401; H04R 2499/15; H04S 7/303; H04S 2400/11
(Continued)

(56) References Cited

U.S. PATENT DOCUMENTS

2014/0126754 A1 5/2014 Mizuta
2014/0133681 A1 5/2014 Mizuta
(Continued)

FOREIGN PATENT DOCUMENTS

JP 2006-246310 A 9/2006
JP 2008-118559 A 5/2008
(Continued)

OTHER PUBLICATIONS

The International Bureau of WIPO, "International Preliminary Report on Patentability," issued in International Application No. PCT/JP2017/037043, of which U.S. Appl. No. 16/341,539 is a U.S. national phase entry, dated Apr. 25, 2019, 8 pages.
(Continued)

*Primary Examiner* — Paul Kim

(57) ABSTRACT

A spatial sound generation device including a storage (106) and a controller (102) and connected to a plurality of speakers (116) is provided. In the spatial sound generation device, referring to information indicating a movable sounding body, the controller varies a transfer characteristic for each time in accordance with movement of the sounding body and applies an inverse filtering to calculate a plurality of input signals for the respective speakers from a sound
(Continued)

source signal indicating a sound emitted by the sounding body. The inverse filtering outputs the input signals into the speakers to form a three-dimensional acoustic wave front under boundary surface control in accordance with a transfer characteristic for a space in which the plurality of speakers are arranged.

22 Claims, 12 Drawing Sheets

(51) Int. Cl.
*H04R 3/12* (2006.01)
*H04R 5/02* (2006.01)
*H04R 5/04* (2006.01)

(52) U.S. Cl.
CPC ..... *H04R 5/04* (2013.01); *H04R 2201/401* (2013.01); *H04R 2499/15* (2013.01); *H04S 2400/11* (2013.01)

(58) Field of Classification Search
USPC ..... 381/303
See application file for complete search history.

(56) References Cited

U.S. PATENT DOCUMENTS

| | | | | |
|---|---|---|---|---|
| 2015/0110310 | A1 | 4/2015 | Minnaar | |
| 2015/0208191 | A1 | 7/2015 | Sako | |
| 2015/0286463 | A1 | 10/2015 | Asada et al. | |
| 2016/0269848 | A1* | 9/2016 | Mitsufuji | H04S 7/30 |

FOREIGN PATENT DOCUMENTS

| | | | |
|---|---|---|---|
| JP | 2014-090910 | A | 5/2014 |
| JP | 2014-094160 | A | 5/2014 |
| WO | 2014/010290 | A1 | 1/2014 |
| WO | 2014/069112 | A1 | 5/2014 |
| WO | 2015/076149 | A1 | 5/2015 |

OTHER PUBLICATIONS

Shiro Ise, "The Boundary Surface Control Principle and Its Applications," IEICE Transactions on Fundamentals of Electronics, Communications and Computer Sciences, vol. E88-A, No. IEICE, Jul. 1, 2005, pp. 1656-1664.

International Search Report received for International Patent Application No. PCT/JP2017/037043, dated Jan. 9, 2018, 4 pages (2 pages of English translation of International Search Report, and 2 pages of International Search Report).

Hotaka Kitabora et al., "Interactive Sound Generation System Based on Body Motion Recognition," Human-Agent Interaction Symposium 2013, pp. 51-54.

Keisuke Ogasawara et al., "Development of the 3-D sound field reproduction system interacting with body action—Fundamental design of the system," Presentation Papers of the Acoustical Society of Japan, Sep. 2013, pp. 715-716.

Masashi Toyota et al., "A New Method of Real-time Rendering of 3-D Acoustic Doppler Effect," Presentation Papers of the Virtual Reality Society of Japan Meeting (CD-ROM), vol. 9 2C3-3, Sep. 8, 2004, pp. 457-460.

* cited by examiner

SPATIAL SOUND GENERATION DEVICE, SPATIAL SOUND GENERATION SYSTEM, SPATIAL SOUND GENERATION METHOD, AND SPATIAL SOUND GENERATION PROGRAM

TECHNICAL FIELD

The present invention relates to a spatial sound generation device, a spatial sound generation system, a spatial sound generation method, and a spatial sound generation program.

BACKGROUND ART

Conventionally, as a reproduction method of sound, a surround reproduction system is known. The surround reproduction system has more channels than the stereo sound reproduction of 2.0 ch, and has an objective to reproduce sound more realistic than the stereo sound. However, in the conventional surround reproduction system, since the sound image localization accuracy is low, it is difficult to achieve high quality sound reproduction required by creators or the like.

Therefore, a sound field reproduction method based on the principle of boundary surface control (BoSC) has been proposed in order to generate a sound field having higher realism (see Patent Document 1). The boundary surface control (BoSC) is based on the principle of a method of setting a sound source at a point away from the boundary and outputting the signal generated by using an inverse filtering from the sound source. Therefore, controlling the sound pressure and the sound pressure gradient on the boundary surrounding the region allows the sound pressure in any region in the three-dimensional sound field to be controlled, and a sound system with immersive feeling to be constructed. As a result, although the realism or immersion as an auditory stimulus can be obtained, the BoSC sound system itself is not an interactive sound system interacting with the user's body.

Here, the virtual table tennis system described in Non-Patent Document 1 describes that rolling sounds and the like of sound balls are recorded in advance with a microphone array of fullerene structure to be stored in a database in a convoluted state with an inverse filter which cancels a transfer function from the speaker of the reproduction sound field to the control point, and ball-hitting sounds and rolling sounds are reproduced in a three-dimensional sound field at the timing of detecting the body motion of ball-hitting motion via the Kinect manufactured by Microsoft Corporation.

In addition, Non-Patent Document 2 describes a system for detecting body movement via the Kinect manufactured by Microsoft Corporation, estimating sounds suitable for body motion from patterns of movement, and changing parameters.

CITATION LIST

Patent Documents

Patent Document 1: JP 2008-118559 A

Non-Patent Documents

Non-Patent Document 1: Keisuke Ogasawara et al., "Development of the 3-D sound field reproduction system interacting with body action—Fundamental design of the system", Presentation Papers of the Acoustical Society of Japan, September 2013, pp. 715-716

Non-Patent Document 2: Hotaka Kitabora et al., "Interactive Sound Generation System Based on Body Motion Recognition", Human-Agent Interaction Symposium 2013, pp 51-54

Non-Patent Document 3: Masashi Toyota (Tohoku University) et al., "A New Method of Real-time Rendering of 3-D Acoustic Doppler Effect", Presentation Papers of the Virtual Reality Society of Japan Meeting (CD-ROM), Vol. 9 2C3-3, 2004 Sep. 8th

SUMMARY OF INVENTION

Technical Problems

However, the conventional sound reproduction system reproduces an acoustic wave front previously recorded by a microphone array or the like having a fullerene structure, and has a problem that it is impossible to generate a three-dimensional acoustic wave front having realistic sensation in a virtual three-dimensional space such as a game space where its contents or the like can be moved freely.

The present invention provides a spatial sound generation device, a spatial sound generation system, a spatial sound generation method, and a spatial sound generation program capable of generating a sound field with a realistic three-dimensional acoustic wave front.

Solutions to Problems

In order to achieve the above objective, the spatial sound generation device of the present invention is a spatial sound generation device connected to a plurality of speakers, the spatial sound generation device including: a storage; and a controller. Referring to information indicating a movable sounding body, the controller varies a transfer characteristic for each time in accordance with movement of the sounding body and applies an inverse filtering to calculate a plurality of input signals for the respective speakers from a sound source signal indicating a sound emitted by the sounding body. The inverse filtering outputs the input signals into the speakers to form a three-dimensional acoustic wave front under boundary surface control in accordance with a transfer characteristic for a space in which the plurality of speakers are arranged.

Further, the present invention relates to a spatial sound generation system. The spatial sound arrangement system of the present invention is a spatial sound generation system including: a plurality of speakers; a storage; and a controller. Referring to information indicating a movable sounding body, the controller varies a transfer characteristic for each time in accordance with movement of the sounding body and applies an inverse filtering to calculate a plurality of input signals for the respective speakers from a sound source signal indicating a sound emitted by the sounding body. The inverse filtering outputs the input signals into the speakers to form a three-dimensional acoustic wave front under boundary surface control in accordance with a transfer characteristic for a space in which the plurality of speakers are arranged.

Further, the present invention relates to a spatial sound generation method. The spatial sound arrangement method of the present invention is a spatial sound generation method to be executed in a computer connected to a plurality of speakers, the computer including a storage and a controller, the spatial sound generation method for causing the controller to execute: referring to information indicating a movable sounding body, varying a transfer characteristic for each time in accordance with movement of the sounding body and applying an inverse filtering to calculate a plurality of input signals for the respective speakers from a sound source signal indicating a sound emitted by the sounding body, the inverse filtering outputting the input signals into the speakers to form a three-dimensional acoustic wave front under boundary surface control in a transfer characteristic for a space in which the plurality of speakers are arranged to cause the speakers to form a three-dimensional acoustic wave front based on the input signals under boundary surface control; and controlling respective speakers based on the input signals.

Further, the present invention relates to a spatial sound arrangement program. The spatial sound arrangement program of the present invention is a spatial sound generation program for causing a computer connected to a plurality of speakers, the computer including a storage and a controller, to execute to cause the controller to execute: referring to information indicating a movable sounding body, varying a transfer characteristic for each time in accordance with movement of the sounding body and applying an inverse filtering to calculate a plurality of input signals for the respective speakers from a sound source signal indicating a sound emitted by the sounding body; with the inverse filtering, outputting the input signals into the speakers to form a three-dimensional acoustic wave front under boundary surface control in accordance with a transfer characteristic for a space in which the plurality of speakers are arranged; and controlling respective speakers based on the input signals.

Advantageous Effects of Invention

According to the present invention, the effect that a sound field accompanied by a three-dimensional acoustic wave front having realistic sensation can be generated is exerted.

DESCRIPTION OF EMBODIMENTS

Hereinafter, a spatial sound generation device, a spatial sound generation system, a spatial sound generation method, a spatial sound generation program, and a recording medium according to embodiments of the present invention will be described in detail with reference to the drawings. It should be noted that the present invention is not limited by these embodiments.

First, the configuration of the present embodiment according to the present invention will be described below, and thereafter the processing and the like of the present embodiment will be described in detail. Here, FIG. 1 is a configuration diagram illustrating a configuration of a spatial sound generation system according to an embodiment of the present invention, and mainly conceptually illustrates a portion relating to the present embodiment out of the configuration.

Figure 1:
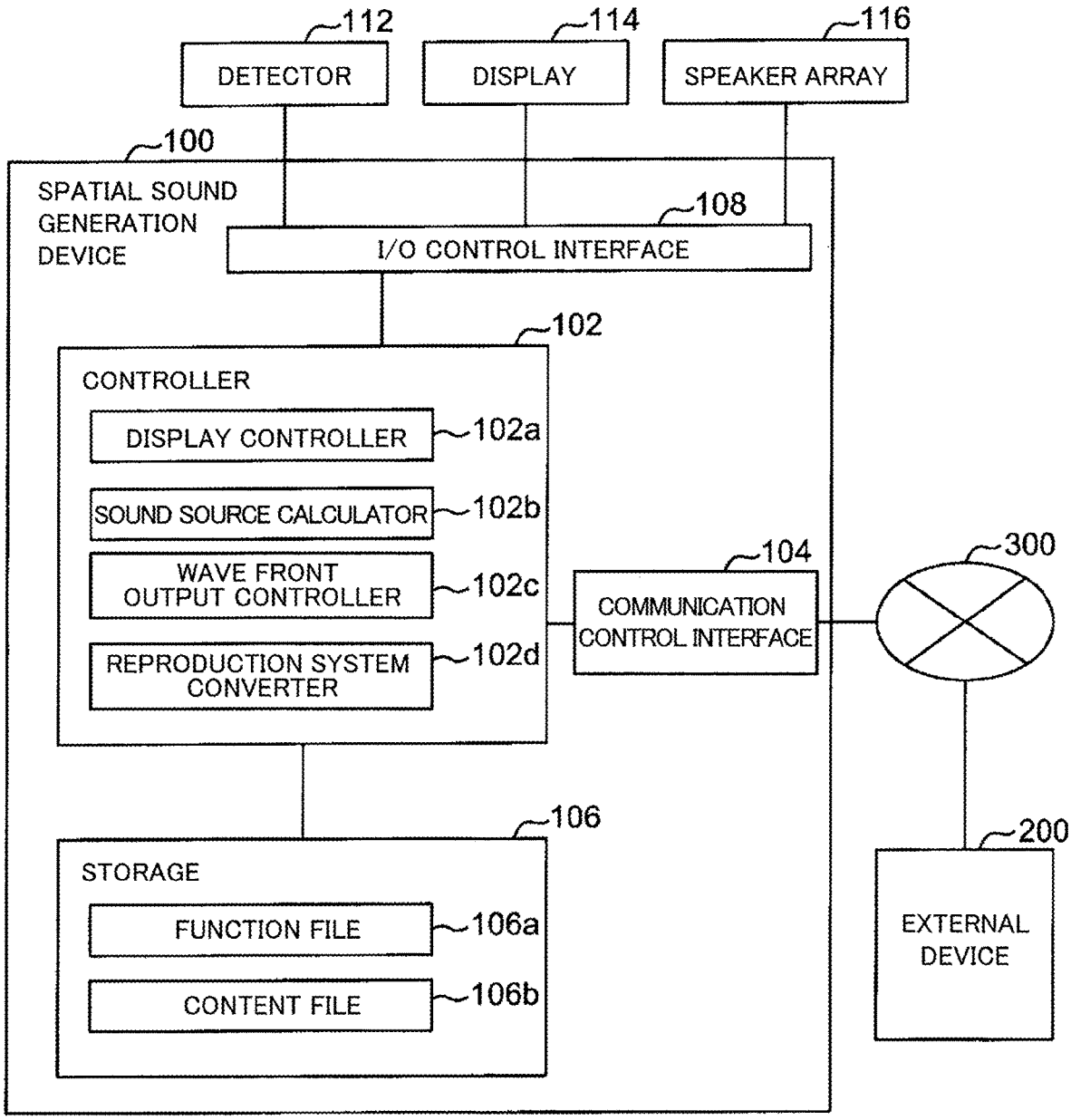
FIG. 1 is a configuration diagram illustrating a configuration of a spatial sound generation system according to an embodiment of the present invention.

As illustrated in FIG. 1, in the present embodiment, the spatial sound generation system includes a spatial sound generation device 100, a detector 112, a display 114, and a speaker array 116. It should be noted that as illustrated in FIG. 1, the spatial sound generation device 100 may be connected to an external device 200 via a network 300. Here, the spatial sound generation device 100 is a personal computer, a server computer, a tablet computer, or the like. The network 300 has a function of mutually connecting the spatial sound generation device 100 and an external apparatus 200, and is, for example, a LAN, the Internet, or the like.

Here, in FIG. 1, the detector 112 is a motion recognition means for recognizing the motion of at least one body part of the user. For example, the detector 112 may recognize the movement of a person by any detection means such as a camera or an infrared sensor. As an example, the detector 112 may detect the movement of the user by using a known gesture recognition technique, a known motion sensor, or the like. A gesture can be obtained from the user's position and movement in physical space, and can express movement of fingers, arms, and legs, or dynamic or static user's any movement such as a static attitude.

As an example of the present embodiment, in the detector 112, a capture device such as a camera may capture user image data and recognize the user's gestures (one or more) from the user image data. More specifically, the detector 112 may transmit the user's motion data, attribute data, and the like obtained by recognizing, analyzing, and interpreting the user's gestures performed by the user in three-dimensional physical space, or the pre-analysis raw data to the spatial sound generation device 100 by using the computer environment. As an example, the detector 112 may recognize movement such as movement of pointing in one direction, movement of pushing hands in one direction, movement of kicking a leg in one direction, movement as if to throw a ball, movement of heading a ball, movement of catching something with both hands, or movement of wielding a baton.

As an example of known motion recognition means, a Kinect sensor of a motion sensor for Xbox One manufactured by Microsoft Corporation may be used. According to Kinect technology, skeleton motion data and attribute data of the whole body can be obtained. It should be noted that in the known motion sensor, the movement or attribute of a person is analyzed by using a control means with a built-in sensor, or the movement or attribute of a person is analyzed by a control means of a connected computer, and any of them may be used in the present embodiment. For example, in the present embodiment, these analysis functions may be achieved by a control means of the detector 112 (processor or the like), may be achieved by a control means of the spatial sound generation device 100 (sound source calculator 102*b* and the like described below), or the analysis functions may be achieved by the control means of both.

In addition, the detector 112 may further include a detection means such as a touch pad, a touch panel, or a microphone array. Furthermore, the detector 112 is not limited to directly detecting the human body, and may indirectly detect movement of the body by detecting movement of a controller or a sign (for example, a two-dimensional code tag) or the like worn by a user, such as the Oculus Touch Controller of the Oculus Rift by Facebook Inc.

In addition, in FIG. 1, the display 114 is a display means for displaying content information. One example of the display 114 may include a head mounted display (HMD), a liquid crystal display, or a projector. It should be noted that the display 114 may perform two-dimensional display or three-dimensional display. As will be described below, the listener listens to the composite sound waves so that the sound image is localized at the position of the sound source displayed on the display 114.

In addition, although not illustrated, the listener may sit on a seat or stand on a vibration plate. Connecting a body sonic transducer to this sheet or vibration plate and controlling the transducer so that the controller vibrates the listener according to the content information allows the listener to enjoy the powerful contents.

In addition, in FIG. 1, the speaker array 116 is a sound output means in which a plurality of speakers are three-dimensionally arranged. In the present embodiment, the speaker array 116 is a speaker array of a boundary surface control (BoSC) reproduction system. Here, FIG. 2 is a diagram illustrating an example of the speaker array of the BoSC reproduction system in the present embodiment.

Figure 2:
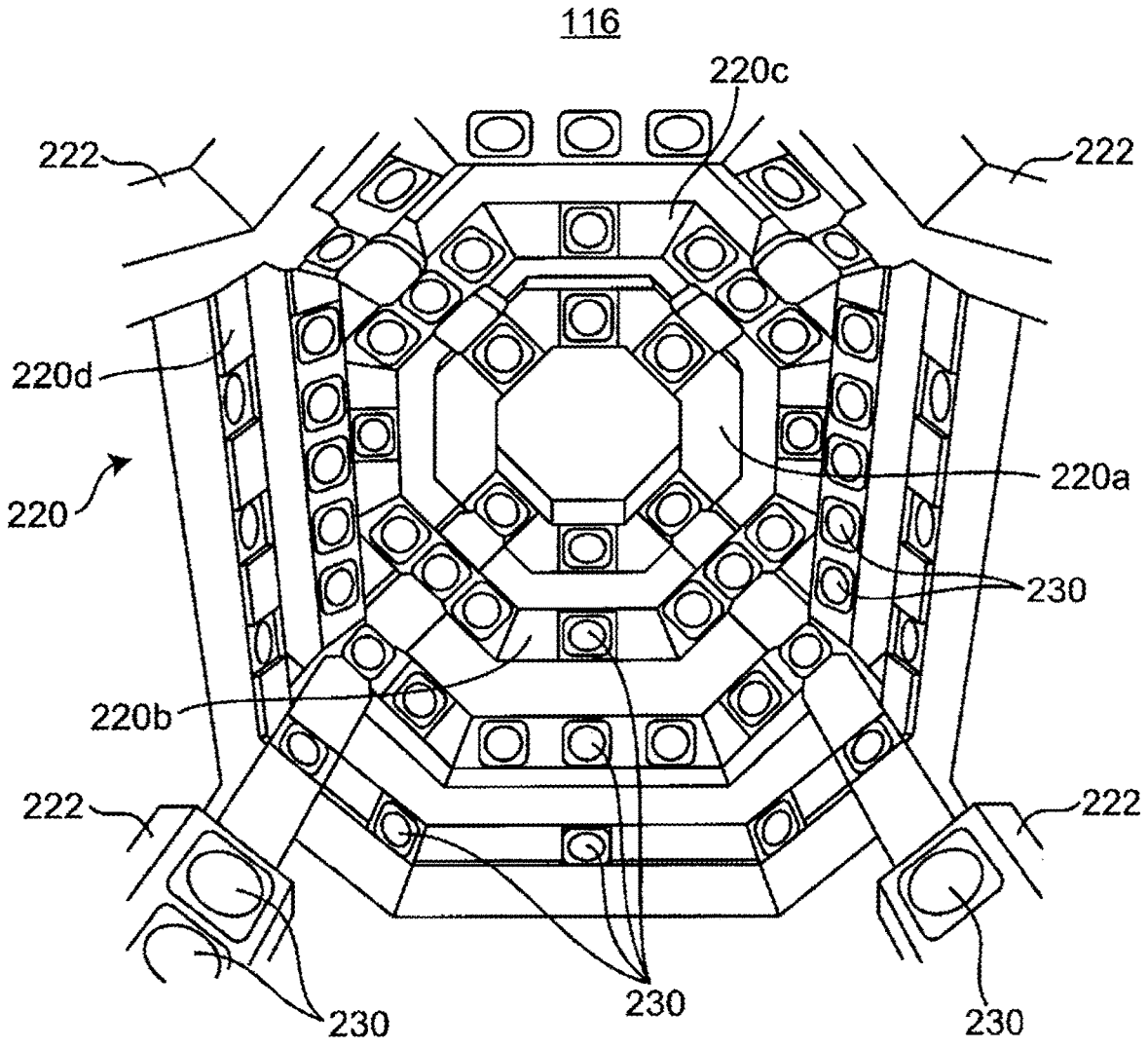
FIG. 2 is a diagram illustrating an example of the speaker array of the BoSC reproduction system in the present embodiment.

FIG. 2 illustrates a speaker array 116 of an acoustic barrel-type forming a barrel-shaped sound field reproduction room. As illustrated in FIG. 2, the speaker array 116 of the present embodiment includes an elliptical dome portion 220 and a pillar portion 222. The elliptical dome portion 220 includes wooden frames 220*a*, 220*b*, 220*c*, and 220*d*, for example. However, FIG. 2 is a view of the inside of the dome portion 220 as viewed obliquely from below, and only a part of the frames 220*d* and the pillar portions 222 are illustrated. Although not illustrated, the insides of the dome portion 220 and the pillar portion 222 are cavities, and the frames 220*a* to 220*d* themselves play a role of a closed-room type enclosure.

In addition, in each of the speaker arrays 116 of the present embodiment, 96 loudspeakers 230 are installed as an example. Here, as the loudspeaker 230, a speaker of a full range unit (Fostex FE83E) or a speaker of a subwoofer unit (Fostex FW108N) for supplementing the low frequency may be installed. Such a speaker array 116 may be installed in the sound field reproduction room, and for example, a YAMAHA woody box (sound insulation performance Dr-30) being a one-and-a-half-mat soundproof chamber may be used. In addition, a chair with a lift (not illustrated), a detector 112 such as KINECT described above, and a display 114 may be provided in the sound field reproduction room.

It should be noted that regarding the speaker array 116 of the BoSC reproduction system and a sound field reproduction system including a computer system and the like thereof, known documents such as "1. Numerical Analysis Technology and Visualization/Audibility 1.7 Three-Dimensional Sound Field Communication System", Seigo Enomoto, Acoustic Technology No. 148/December 2009 pp 37-42 and JP 2012-85035 A may be referred to.

Then, the configuration of the spatial sound generation device 100 according to the present embodiment will be described. As illustrated in FIG. 1, the spatial sound generation device 100 is configured to schematically include a controller 102 such as a CPU for controlling the whole of the spatial sound generation device 100, a communication control interface 104 connected to a communication device (not illustrated) such as a router connected to a communication line or the like, an input/output control interface 108 connected to the detector 112 such as a touch panel, the display 114, the speaker array 116, and the like, and a storage 106 for storing various databases, tables, and the like, and these respective units are communicably connected to each other via any communication path.

The storage 106 stores various databases and tables (for example, a function file 106*a*, a content file 106*b*, and the like). The storage 106 is a storage means such as a small capacity high speed memory formed with a static random access memory (SRAM) or the like (for example, a cache memory) or a fixed disk device such as a hard disk drive (HDD) or a solid state drive (SSD), and stores various programs, tables, files, databases, web pages, and the like, used for various pieces of processing.

Figure 3:
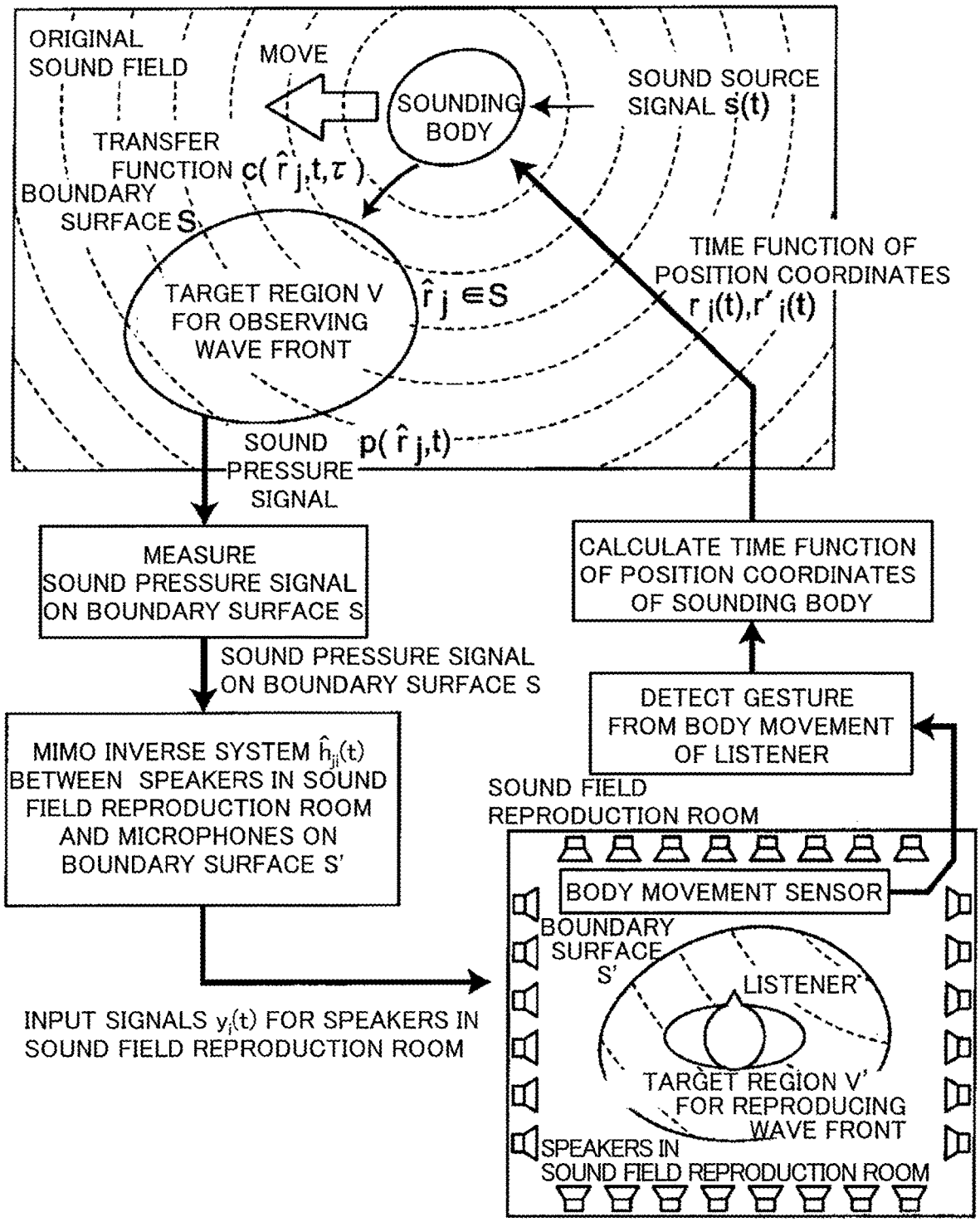
FIG. 3 is a diagram illustrating a configuration example of a 3D wave front generation system with a moving sounding body based on the principle of boundary surface control (BoSC).

The function file 106*a* is a function storage means for storing a function for performing signal processing. For example, in the present embodiment, the function file 106*a* stores an inverse filtering for outputting an input signal from the sound pressure signal on the boundary surface of the region including the user's head to each speaker of the speaker array 116, and a reproduction signal output function based on the transfer function from the position coordinates of the sounding body in the virtual three-dimensional space to the position coordinates of the sound pressure signal on the boundary surface. Here, referring to FIG. 3, the reproduction signal output function of the present embodiment will be described. FIG. 3 is a diagram illustrating a configuration example of a 3D wave front generation system with a moving sounding body based on the principle of boundary surface control (BoSC). In the following, application examples of the boundary element method to this system will be described.

1. Physical Condition of Sounding Body 1.1 N Point Sound Sources

First, in the sounding body, let $q_i(\omega)$ be the magnitude of the ith point sound source, and let $r'(t)$ be the position at time t.

1.2 Sounding Body Having A Shape

Here, let S be the boundary surface of the shape of the moving sounding body. The boundary surface S includes a surface S' whose vibration surface is known and a wall surface S" whose acoustic admittance is known. When the boundary surface S is divided into M micro elements, let the first to M'th elements be included in the surface S', and let the (M'+1)th to Mth elements be included in the surface S".

1.2.1 Vibration Surface

Let $u_i(\omega)$ (i=1 to M') be the vibration velocity of the ith element and let $r_i(t)$ ($\epsilon$S') be the position at time t.

1.2.2 Non-Vibration Surface

Let $z_i(\omega)$ (i=(M'+1) to M) be the acoustic admittance of the ith element of the wall surface and let $r_i(t)$ ($\epsilon$S') be the position at time t.

1.3 Sound Source Signal S(ω) for Driving Sounding Body

The magnitude of the point sound source $q_i(\omega)$ and the vibration velocity of the sound source $u_i(\omega)$ are proportional to the sound source signal S(ω), and they are expressed as $q_i(\omega)=a_i(\omega)S(\omega)$ and $u_i(\omega)=b_i(\omega)S(\omega)$ by using the proportional constants $a_i(\omega)$ and $b_i(\omega)$.

This is the physical condition of the sounding body. Next, the sound pressure signal on the boundary surface S surrounding the target region (that is, corresponding to the region including the head of the listener) V for observing the wave front by the sounding body of the physical condition described above will be described.

2. Sound Pressure Signal on Boundary Surface S Surrounding Target Region V for Observing Wave Front The boundary surface S is discretized into elements of N points, let the position of the jth element be $\hat{r}_j$ (for the convenience of notation, "^" is written following the previous letter, but is officially written over the previous letter (the same applies below)), and let the sound pressure signal at time t be $p(\hat{r}_j, t)$.

3. System $c(\hat{r}_j, t, \tau)$

In this case, the system $c(\hat{r}_j, t, \tau)$ with the sound source signal s(t) for driving the moving sounding body (composition of a point sound source positioned at r'(t) and a sounding body having a shape where each element is positioned at $r_i(t)$) as an input and with the sound pressure signal $p(\hat{r}_j, t)$ at the sound receiving point as an output can be expressed as follows.

[Math. 1]

$$p(\hat{r}_j,t)=\int_0^{\infty}c(\hat{r}_j,t,\tau')s(t-\tau')d\tau' \quad (1)$$

where the $c(\hat{r}_j, t, \tau)$ represents a time-varying transfer characteristic, and is a time-varying system in which the transfer function changes according to the time t as the sounding body moves. Therefore, the following arithmetic expression on the frequency axis by the Fourier transform of Formula (1) does not hold (the calculation method of the $c(\hat{r}_j, t, \tau)$ is described below in 7.).

$$P(\hat{r}_j,\omega)=C(\hat{r}_j,t,\omega)\cdot S(\omega) \quad \text{[Math. 2]}$$

4. Inverse filtering

Here, an inverse filtering, that outputs input signals to the speakers of the sound field reproduction speaker array 116 from the sound pressure signal $p(\hat{r}_j, t)$ measured at N points on the boundary surface S (closed surface) surrounding the target region V (closed region) for observing wave front, is considered. In the present embodiment, the inverse filtering is a generic name for M×N inverse filter groups. It should be noted that as a method for designing an inverse filter, a known document (S. Enomoto et al., "Three-dimensional sound field reproduction and recording systems based on boundary surface control principle", Proc. of 14th ICAD, Presentation o 16, 2008 Jun.) can be referred to.

First, M speakers are installed in the sound field reproduction room in which the speaker array 116 is installed, and microphones are installed in N pieces on the boundary surface S' (closed surface) surrounding the target region V' (closed region) for reproducing wave front. Then, the impulse responses $h_{ij}(t)$ (i−1 to M, j−1 to N) from the i-th speaker (i −1 to M) to the j-th microphone (j−1 to N) are measured and Fourier transformed. Here, $H_{ij}(\omega)$ is a transfer function from the sound source i to the position point j of the microphone and can be expressed as the following formula.

$$H_{ij}(\omega)=\int_{-\infty}^{\infty}h_{ij}(t)e^{-j\omega t}dt \quad \text{[Math. 3]}$$

Furthermore, $H_{ij}(\omega)$ can be expressed as the following matrix for each angular velocity ω.

[Math. 4]

$$[H_{ij}(\omega)]=\begin{bmatrix} H_{11}(\omega) & \dots & H_{1N}(\omega) \\ \vdots & \ddots & \vdots \\ H_{M1}(\omega) & \dots & H_{MN}(\omega) \end{bmatrix}$$

Then, in order to obtain the inverse filtering $\overline{H}_{ji}(\omega)$, the pseudo-inverse matrix $[\overline{H}_{ji}(\omega)]$ of $[H_{ij}(\omega)]$ such that $[\overline{H}_{ji}(\omega)]\,[\overline{H}_{ji}(\omega)]=I$ (where I is an N dimensional unit matrix) is obtained. Here, the pseudo-inverse matrix $[\overline{H}_{ji}(\omega)]$ can be expressed as follows.

[Math. 5]

$$[\hat{H}_{ji}(\omega)]=\begin{bmatrix} \hat{H}_{11}(\omega) & \dots & \hat{H}_{1M}(\omega) \\ \vdots & \ddots & \vdots \\ \hat{H}_{N1}(\omega) & \dots & \hat{H}_{NM}(\omega) \end{bmatrix}=\begin{bmatrix} H_{11}(\omega) & \dots & H_{1N}(\omega) \\ \vdots & \ddots & \vdots \\ H_{M1}(\omega) & \dots & H_{MN}(\omega) \end{bmatrix}^{-1}$$

Then, the reproduction signal $Y_i(\omega)$ output from the i-th speaker (i=1 to M) of the speaker array 116 is calculated by the following mathematical expression for multiplying the sound pressure signal $P(\hat{r}_j, t)$ on the boundary surface S in the original sound field by the inverse filtering $\overline{H}_{ji}(\omega)$ to obtain the total sum with respect to j.

[Math. 6]

$$Y_i(\omega)=\sum_{j=1}^{N}\hat{H}_{ji}(\omega)\cdot P(\hat{r}_j,\omega)$$

Fourier-transforming the above formula can be expressed as the following formula.

[Math. 7]

$$y_i(t)=\sum_{j=1}^{N}\int_0^{\infty}\hat{h}_{ji}(\tau'')p(\hat{r}_j,t-\tau'')d\tau'' \quad (2)$$

where $\overline{h}_{ji}(t)$ is as follows.

[Math. 8]

$$\hat{h}_{ji}(t)=\frac{1}{2\pi}\int_{-\infty}^{\infty}\hat{H}_{ji}(\omega)e^{j\omega t}d\omega$$

According to the algorithm of the inverse filtering $\overline{H}_{ji}(\omega)$ (or equivalently $\overline{h}_{ji}(t)$) as described above, the reproduction signal $Y_i(\omega)$ (or $y_i(t)$) can be output so as to cancel the influence of the transfer function $H_{ij}(\omega)$ in the space where the speaker array 116 is installed.

5. Reproduction Signal Output Function $f_i(t, \tau)$

Here, substituting formula (1) into formula (2) allows the reproduction signal $y_i(t)$ to be expressed as follows.

[Math. 9]

$$y_i(t) = \sum_{j=1}^{N} \int_0^\infty \hat{h}_{ji}(\tau'') \int_0^\infty c(\hat{r}_j, t-\tau'', \tau') s(t-\tau''-\tau') d\tau' d\tau'' \tag{3}$$

further, given $\tau=\tau''+\tau'$ $$= \int_0^\infty \sum_{j=1}^{N} \int_0^\infty \hat{h}_{ji}(\tau'') c(\hat{r}_j, t-\tau'', \tau-\tau'') d\tau'' s(t-\tau) d\tau \tag{4}$$

Therefore, setting $f_i(t, \tau)$ as the following can determine the output function of the reproduction signal $y_i(t)$.

[Math. 10]

$$f_i(t, \tau) = \sum_{j=1}^{N} \int_0^\infty \hat{h}_{ji}(\tau'') c(\hat{r}_j, t-\tau'', \tau-\tau'') d\tau'' \tag{41}$$

$$y_i(t) = \int_0^\infty f_i(t, \tau') s(t-\tau) d\tau \tag{42}$$

The reproduction signal output function on the reproduction signal $y_i(t)$ described above is a system $f_i(t, \tau)$ with the sound source signal s(t) as input and with the reproduction signal $y_i(t)$ at the sound receiving point as output. Thus, using the inverse filtering in consideration of the time-varying transfer characteristic from the moving sounding body to the sound pressure signal on the boundary surface of the region including the user's head allows an input signal from the sound source signal of the moving sounding body to the speaker to be obtained. For example, making the position coordinate of the above formula (41) $\hat{r}_j$ into a function in a settable manner as a function of time t may configure a reproduction signal output function corresponding to the above formula (42) or the like.

6. Consideration of Doppler Effect

Figure 4:
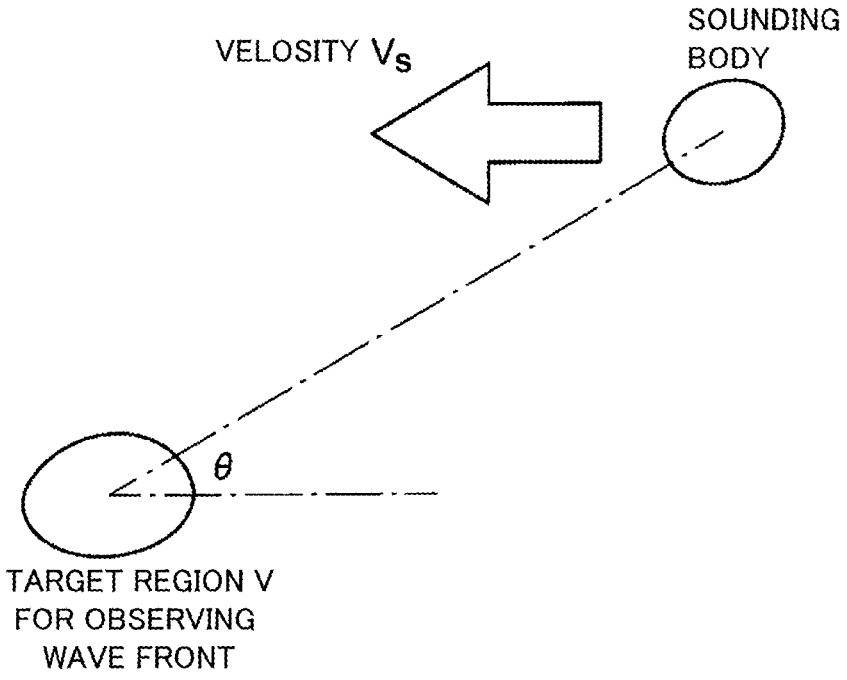
FIG. 4 is a diagram schematically illustrating the relationship between the moving sounding body and the region V.

When the sounding body moves at high speed, a frequency shift due to the Doppler effect occurs. Here, FIG. 4 is a diagram schematically illustrating the relationship between the moving sounding body and the region V. As illustrated in FIG. 4, when the size of the sounding body and the size of the wave front observation target region are sufficiently smaller than the distance between the center coordinates of the sounding body and the center coordinates of the wave front observation target region, let the speed of the sounding body be $v_s$, let the angle formed between the movement direction of the sounding body and the wave front direction be θ, and let the sound speed be $v_c$, the sound pressure signal measured in the wave front observation target region is as follows.

[Math. 11]

$$p\left(r_j, \left(\frac{v_c}{v_c - v_s\cos\theta}\right)\omega\right) \tag{43}$$

inversely Fourier-transformed $$p\left(r_j, \left(1 - \frac{v_s\cos\theta}{v_c}\right)t\right) \tag{44}$$

In this case, the above-described reproduction signal output function (formula (42)) can be expressed as the following formula considering the Doppler effect.

[Math. 12]

$$y_i(t) = \int_0^\infty f_i\left(\left(1 - \frac{v_s\cos\theta}{v_c}\right)t, \tau'\right) s\left(\left(1 - \frac{v_s\cos\theta}{v_c}\right)t - \tau\right) d\tau \tag{45}$$

7. Calculation Method of Transfer Function $c(\hat{r}_j, t, \tau)$ 7.1 Formulation of Transfer Function when Time is Fixed Kirchhoff-Helmholtz integral equation is described using the physical parameters described in <1. Physical Model of Sounding Body> as described above. When the position vector of the sounding body at a certain time t is fixed, that is, let $r'i(t)=r'$, $r_i(t)=r_i$, the magnitude of the point sound source can be expressed as the following formula.

[Math. 13]

$$\alpha(s)P(s, \omega) = j\omega\rho_0 \sum_{i=1}^{N} q_i(\omega) G(|r_i' - s|, \omega) - j\omega\rho_0 \iint_{S'} u_i(\omega) G(|r_i - s|, \omega) dS - j\omega\rho_0 \iint_{S''} z_i(\omega) P(r_i, \omega) G(|r_i - s|, \omega) dS - \iint_{S'+S''} P(r_i, \omega) \frac{\partial G(|r_i - s|, \omega)}{\partial n} dS$$

Here, further discretizing obtains the following formula.

[Math. 14]

$$\alpha(s)P(s, \omega) = j\omega\rho_0 \sum_{i=1}^{N} q_i(\omega) G(|r_i' - s|, \omega) - j\omega\rho_0 \sum_{i=1}^{M'} u_i(\omega) \iint_{S_i} G(|r_i - s|, \omega) dS - j\omega\rho_0 \sum_{i=M'+1}^{M} z_i(\omega) P(r_i, \omega) \iint_{S_i} G(|r_i - s|, \omega) dS - \sum_{i=1}^{M} P(r_i, \omega) \iint_{S_i} \frac{\partial G(|r_i - s|, \omega)}{\partial n} dS \tag{5}$$

Let $s=r_j$ (j−1 to M), and let the above formula (5) be simultaneous, since $\alpha(s)=½$ (s∈S', S"), the following formula is obtained.

[Math. 15]

$$\frac{1}{2}P(r_j,\omega)=j\omega\rho_0\sum_{i=1}^{N}q_i(\omega)G'_{ij}(\omega)-j\omega\rho_0\sum_{i=1}^{M'}u_i(\omega)G_{ij}(\omega)-j\omega\rho_0\sum_{i=M'+1}^{M}z_i(\omega)P(r_i,\omega)G_{ij}(\omega)-\sum_{i=1}^{M}P(r_i,\omega)G^n_{ij}(\omega)$$

where $$G'_{ij}(\omega)=G(|r'_i-r_j|,\omega)$$

$$G_{ij}(\omega)=\int\int_{S_i}G(|r_i-r_j|,\omega)dS$$

$$G^n_{ij}(\omega)=\int\int_{S_i}\frac{\partial G(|r_i-r_j|,\omega)}{\partial n}dS$$

The term of $P(r_j, \omega)$ is shifted to the left side, and expressed as a matrix as follows.

[Math. 16]

$$\left(\frac{1}{2}I_M+G_n(\omega)+j\omega\rho_0G(\omega)Z(\omega)\right)P(\omega)=g'(\omega)Q(\omega)-j\omega\rho_0G(\omega)U(\omega)$$

where

[Math. 17]

$$G_n(\omega)=[G^n_{ij}(\omega)]\in C^{M\times M},$$
$$G(\omega)=[G_{ij}(\omega)]\in C^{M\times M}$$
$$g(\omega)'=[G'_{ij}(\omega)]\in C^{M\times N},$$
$$Q(\omega)=[q_1(\omega),q_2(\omega)\ \dots\ q_N(\omega)]^T\in C^N$$
$$P(\omega)=[P(r_1,\omega),P(r_2,\omega)\ \dots\ P(r_M,\omega)]^T\in C^M$$
$$Z(\omega)=\mathrm{diag}(0\ \dots\ 0z_{M'+1}(\omega)\ \dots\ z_M(\omega))\in C^{M\times M}$$
$$U(\omega)=\mathrm{diag}(u_1(\omega)\ \dots\ u_{M'}(\omega)\ 0\ \dots\ 0)\in C^{M\times M}$$

Therefore, the sound pressure on the boundary surfaces S' and S" can be obtained by the following formula.

[Math. 18]

$$P(\omega)=\left(\frac{1}{2}I_M+G_n(\omega)+j\omega\rho_0G(\omega)Z(\omega)\right)^{-1}(g'(\omega)Q(\omega)-j\omega\rho_0G(\omega)U(\omega)) \quad (6)$$

The sound pressure signal at the sound receiving point $\hat{r}_j$ ($\alpha(s)=1$) in the external region of the sounding body is obtained by substituting formula (6) into formula (5) as follows.

[Math. 19]

$$P(\hat{r}_j,\omega)=g'_j(\omega)Q(\omega)-j\omega\rho_0\hat{G}_j(\omega)U(\omega)-\left(\hat{G}_{nj}(\omega)+j\omega\rho_0\hat{G}_j(\omega)Z(\omega)\right)P(\omega)$$

where $$g'_i(\omega)=\left[\hat{G}'_{ij}(\omega)\right]\in C^{M\times N}$$
$$\hat{G}_{nj}(\omega)=\left[\hat{G}^n_{ij}(\omega)\right]\in C^{M\times N}$$
$$\hat{G}_j(\omega)=\left[\hat{G}_{ij}(\omega)\right]\in C^{M\times M}$$
$$\hat{G}_{ij}(\omega)=G(|r'_i-\hat{r}_j|,\omega)$$

-continued $$\hat{G}_{ij}(\omega)=\int\int_{S_i}G(|r_i-r_j|,\omega)dS$$

$$\hat{G}^n_{ij}(\omega)=\int\int_{S_i}\frac{\partial G(|r_i-r_j|,\omega)}{\partial n}dS$$

Solving the above equation obtains a sound pressure signal at the sound receiving point $\hat{r}_j$ ($\alpha(s)=1$) in the external region of the sounding body. In addition, since $q_i(\omega)=a_iS(\omega)$, $u_i(\omega)=b_iS(\omega)$, the system $C(\hat{r}_j, \omega)$ with the sound source signal $S(\omega)$ as input and with the sound pressure at the sound receiving point $P(\hat{r}_j, \omega)$ as output is obtained as follows.

[Math. 20]

$$C(\hat{r}_j,\omega)=g'_j(\omega)A(\omega)-j\omega\rho_0\hat{G}_j(\omega)B(\omega)-\left(\hat{G}_{nj}(\omega)+j\omega\rho_0\hat{G}_j(\omega)Z(\omega)\right)\left(\frac{1}{2}I_M+G_n(\omega)+j\omega\rho_0G(\omega)Z(\omega)\right)^{-1}(g'(\omega)A(\omega)-j\omega\rho_0G(\omega)B(\omega)) \quad (7)$$

where $$A=\mathrm{diag}(a_1(\omega)\ \dots\ a_N(\omega))\in C^N$$
$$B=\mathrm{diag}(b_{1(\omega)}\ \dots\ b_{M'}(\omega)\ 0\ \dots\ 0)\in C^{M\times M}$$

7.2 Formulation of Transfer Function when Time is Considered

Then, in order to release time fixation, let $r'_i=r'(t)$ and $r_i=r_i(t)$ be the position vector of the sounding body, and the transfer function $c(\hat{r}_j, t, \tau)$ at time t of the moving sounding body is obtained. That is, let $c(\hat{r}_j, t, w)$ be the $c(\hat{r}_j, W)$ obtained by replacing the distance calculation between vectors such as $|r'_i-r_j|$, $|r_i-r_j|$, $|r'_i-\hat{r}_j|$ used in the above formula (7) with $|r'_i(t)-r_j|$, $|r_i(t)-r_j(t)|$, $|r'_i(t)-\hat{r}_j|$. Furthermore, inverse-Fourier transforming the obtained $c(\hat{r}_j, t, \omega)$ allows the transfer function $c(\hat{r}_j, t, \tau)$ of the system considering time to be obtained as the following formula.

[Math. 21]

$$c(\hat{r}_j,t,\tau)=\frac{1}{2\pi}\int_{-\infty}^{\infty}C(\hat{r}_j,t,\omega)e^{j\omega\tau}d\omega$$

The above is an example of the reproduction signal output function of the present embodiment stored in the function file 106*a*. It should be noted that a reproduction signal output function may be obtained by a known approximate method or the like based on the principle of boundary surface control (BoSC), not limited to the above-described reproduction signal output function. For example, in the above description, an example of using the boundary element method is described to obtain the reproduction signal output function, but various numerical calculation methods such as the finite element method and the difference method may be used instead of the boundary element method.

Returning to FIG. 1 again, the content file 106*b* is a content information storage means for storing content information. For example, the content file 106*b* may store various data (image data, sound source data, and the like) that can be arranged in the virtual space. As an example, the content file 106*b* may store various element data (polygon data, attribute data, and the like) constituting a three-dimensional virtual space such as a game space. Some of such element data are associated with data such as a sound source signal as the above-described sounding body. The content data is an example of information indicating the physical condition (that is, boundary condition) of the sounding body.

As an example, the content file 106*b* may store content information for defining a three-dimensional virtual space in which an orchestra player can be virtually arranged. It should be noted that the content file 106*b* may temporarily or permanently acquire and store the content information from the external device 200 such as a server via the network 300.

In addition, in FIG. 1, the input/output control interface 108 is an example of an interface for controlling the detector 112 such as a keyboard and the output unit 114. The input/output control interface 108 includes one or a plurality of interface circuits. As the output unit 114 as a display means, a monitor (including a home TV, a touch screen monitor, and the like) and the like can be used. In addition, as the detector 112, a positional information acquisition means such as a GPS sensor or an IMES sensor, various sensors such as a touch panel, an audio microphone, a keyboard, a camera, and an acceleration sensor, and the like can be used. As an example, the detector 112 and the output unit 114 may be an input/output means such as a touch panel which combines an output unit 114 such as a liquid crystal panel and a detector 112 such as a touch position input device.

In addition, in FIG. 1, the controller 102 includes an internal memory for storing a control program such as an operating system (OS), a program for prescribing various processing procedures, and required data. The controller 102 is a processor such as a CPU for performing information processing for executing various processes with a program or the like stored in the internal memory. The controller 102 functionally conceptually includes a display controller 102*a*, a sound source calculator 102*b*, a wave front output controller 102*c*, and a reproduction system convertor 102*d*.

The display controller 102*a* is a display controller for display-controlling content information. For example, the display controller 102*a* may control displaying content information according to the motion of the body part detected by the detector 112. As an example, the display controller 102*a* may perform display control involving movement of content information instructed by the motion of a user's finger or the like detected by the detector 112. For example, the display controller 102*a* may display each element of the virtual three-dimensional space read from the content file 106*b* on the display 114 such as a head-mounted display (HMD), may control the user so that the user points at the element with a finger via the detector 112, and may move the pointed element in accordance with the movement of the user's hand as a movement target.

The display controller 102*a* is not limited to the above example, and may display a game space including a game element to move an element such as a ball on display according to the user's movement of throwing the virtual ball or the like, movement of performing kicks and headings, and movement of capturing with both hands. It should be noted that the display controller 102*a* may cause not only movement of elements but also generation or extinction of elements according to the motion of the user. It should be noted that as a control method with the display controller 102*a* via this detector 112, a known noncontact game control method such as Xbox manufactured by Microsoft Corporation may be used. It should be noted that since the user and the contents are in a relative positional relationship in the virtual space, display-controlling the content information by the display controller 102*a* according to the motion detected by the detector 112 also includes a case where the user changes its position according to the motion in the virtual space.

In addition, the sound source calculator 102*b* is a sound source calculation means for calculating an input signal to the speaker from the sound source signal of the moving sounding body by using an inverse filtering considering the time-varying transfer characteristic from the moving sounding body to the sound pressure signal on the boundary surface of the region including the user's head. For example, the sound source calculator 102*b* may calculate an input signal from the sound source signal based on the function stored in the function file 106*a*.

As an example, the sound source calculator 102*b* may calculate a sound source signal of the corresponding sounding body and a time function of the position coordinates according to the change of the content information corresponding to the motion of the body part of the user. That is, the sound source calculator 102*b* reads the sound source signal s(t) associated with the content element being the target of the change such as movement from the content file 106*b* or the like according to the change of the content information by the display controller 102*a*, and performs signal processing from the time functions of the position coordinates $r_i(t)$ and $r'_i(t)$ accompanying the change of the content information corresponding to the motion of the body part of the user via the detector 112. For example, in the present embodiment, the sound source calculator 102*b* substitutes the sound source signal s(t), $r_i(t)$, and $r'_i(t)$ into the above formulae (41) and (42) stored in the function file 106*a*.

In addition, the sound source calculator 102*b* may calculate a reproduction acoustic wave front signal for reproducing the Doppler shift according to the velocity of the user and/or the sounding body in the virtual three-dimensional space. Specifically, as an example, the sound source calculator 102*b* can obtain the reproduction acoustic wave front signal considering the Doppler shift by the substitution into the above-described expressions (43) and (44), formula (45), and the like stored in the function file 106*a*. It should be noted that the sound source calculator 102*b* may calculate the time functions of the position coordinates $r_i(t)$ and $r_i'(t)$ based on the relative positional relationship between the user and the sounding body in the virtual three-dimensional space. Thus, for example, not only a case where the sounding body is moving toward the region V of the listener at the speed vs but also a case where the region V of the listener is moving toward the sounding body can cause the Doppler effect to occur.

In addition, the wave front output controller 102*c* is a wave front output control means in which inputting the input signal obtained by the sound source calculator 102*b* into each speaker of the speaker array 116 causes a three-dimensional acoustic wave front by a sounding body moving in a virtual three-dimensional space to be formed. For example, the wave front output controller 102*c* inputs the input signal derived by inputting the sound source signal and the time function of the position coordinates of the sounding body into the reproduction signal output function of the function file 106*a* obtained by the sound source calculator 102*b* into each speaker of the speaker array 116, whereby the wave front output controller 102*c* may output-control a three-dimensional acoustic wave front by a sounding body moving in a virtual three-dimensional space. More specifically, the wave front output controller 102*c* inputs the input signal $y_i(t)$ derived by inputting the sound source signal s(t) and the time functions of the position coordinates $r_i(t)$ and $r_i'(t)$ of the sounding body into the reproduction signal output functions (above-described formulae (4) to (42) and the like) into each speaker of the speaker array 116, thereby forming a 3D acoustic wave front in the sound field reproduction room. This makes it possible to output sound with enhanced sound image localization accuracy.

In addition, the reproduction system convertor 102*d* is a reproduction system converter for converting the acoustic wave front output or the like by the reproduction acoustic wave front signal into another known reproduction system. For example, the reproduction system convertor 102*d* can convert the acoustic wave front outputs of the 96 channel reproduction acoustic wave front signals by the speaker array 116 into a 2 channel stereophonic reproduction system or a 5.1 channel reproduction system by using a known reproduction system conversion method. Thus, the three-dimensional sound source space arrangement results produced by a user such as a creator under the environment with good sound image localization accuracy can be data-converted and distributed so as to be reproducible also by stereo speakers and surround speaker groups. For example, the reproduction system convertor 102*d* may transmit the converted music data or the like to another external device 200 via the network 300.

In the present embodiment, the spatial sound generation device 100 may be communicably connected to the network 300 via a communication device such as a router and a wired or wireless communication line such as a dedicated line. It should be noted that the spatial sound generation device 100 may be configured to be communicably connected to an external device 200 for providing a content database for storing content information and an external program such as a spatial sound generation program and the like via the network 300.

In addition, in FIG. 1, the communication control interface 104 is a device for performing communication control between the spatial sound generation device 100 and the network 300 (or a communication device such as a router). That is, the communication control interface 104 has a function of communicating data with another terminal or station via a communication line (regardless of whether it is wired or wireless). In the present embodiment, the communication control interface 104 performs communication control with the external device 200 or the like. That is, the external device 200 is connected to the spatial sound generation device 100, the detector 112, and the display 114 via the network 300, and may have a function of providing an external database and a web site for executing an external program and the like such as a program to each terminal.

Here, the external device 200 may be achieved by hardware elements such as a personal computer and a server computer, and software elements such as an operating system, an application program, and other data. For example, the external device 200 may be configured as a WEB server, an ASP server, or the like, and the hardware configuration thereof may be configured by an information processing device such as a commercially available workstation or personal computer and its accessory device. In addition, each function of the external device 200 is achieved by a processor such as a CPU in the hardware configuration of the external device 200, a disk device, a memory device, an input device, an output device, a communication control device and the like, and a program and the like for controlling them.

This concludes the description of each configuration of the spatial sound generation system of the present embodiment.

[Basic Processing]

First, an example of the basic processing of the spatial sound generation system according to the present embodiment will be described with reference to FIG. 5. Here, FIG. 5 is a flowchart illustrating an example of basic processing in the spatial sound generation system of the present embodiment.

Figure 5:
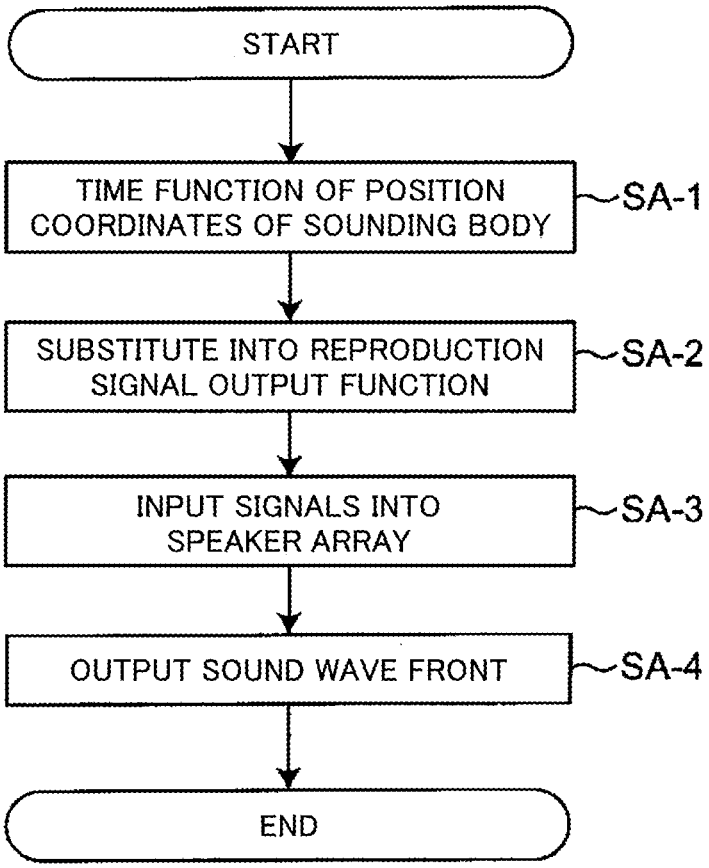
FIG. 5 is a flowchart illustrating an example of basic processing in the spatial sound generation system of the present embodiment.

As illustrated in FIG. 5, first, the spatial sound generation device 100 of the present spatial sound generation system calculates a sound source signal s(t) and time functions of position coordinates $r_i(t)$ and $r'_i(t)$ of a sounding body capable of moving in the virtual three-dimensional space under the control of the sound source calculator 102*b* (step SA-1). Here, the movement of the sounding body may be a predetermined movement, or may be a movement accompanying an input from the user.

For example, the sound source calculator 102*b* may calculate the position coordinates and the sound source signal based on the movement locus data stored in the content file 106*b* or the like. In addition, the sound source calculator 102*b* may calculate the sound source signal s(t) corresponding to the contents of the moving target and the time functions of the position coordinates $r_i(t)$ and $r'_i(t)$ of the content element accompanying the change in the content information according to a change in game content information or the like by a user's input.

Then, the spatial sound generation device 100 of the present spatial sound generation system substitutes the sound source signal s(t) and the time functions of the movement coordinates $r_i(t)$ and $r'_i(t)$ into the reproduction signal output function stored in the function file 106*a* under the control of the sound source calculator 102*b* (step SA-2). According to the above processing (steps SA-1 to SA-2), using the inverse filtering in consideration of the time-varying transfer characteristic from the moving sounding body to the sound pressure signal on the boundary surface of the region including the user's head allows an input signal from the sound source signal of the moving sounding body to the speaker to be calculated.

That is, since the reproduction signal output function is a reproduction signal output function "$y_i(t)=\Sigma f_i(t, \tau')s(t-\tau)d\tau$ (for example, formulae (41) and (42))" based on the inverse filtering $\hat{H}_{ji}(\omega)$ for outputting an input signal $Y_i(\omega)$ (i=1 to M) from the sound pressure signal $p(\hat{r}_j, t)$ on the boundary surface S' of the region V' including the user's head to each speaker of the speaker array 116 and the transfer function $c(\hat{r}_j, t, \tau)$ from the position coordinates of the sounding body in the virtual three-dimensional space $r_j(t)$ (j=1 to N) to the position coordinates $\hat{r}_j$ of the sound pressure signal $p(\hat{r}_j, t)$ on the boundary surface S', an input signal $Y_i(\omega)$ to each speaker of the speaker array 116 can be obtained.

Then, in the following processing (steps SA-3 to SA-4), inputting the input signal calculated as described above into each speaker of the speaker array forms a three-dimensional acoustic wave front. That is, under the control of the wave front output controller 102*c*, the spatial sound generation device 100 of the present spatial sound generation system inputs the input signal $y_i(t)$ obtained in step SA-2 into each speaker (1 to M) of the speaker array 116 (step SA-3).

Then, the speaker array 116 of the present spatial sound generation system outputs a three-dimensional acoustic wave front by a sounding body moving in a virtual three-dimensional space with a speaker output corresponding to the input signal $y_i(t)$ (step SA-4).

The above is an example of basic processing of the spatial sound generation system. Thus, it is possible to generate a sound field accompanied by a three-dimensional acoustic wave front having realistic sensation even when contents or the like can be freely moved in a virtual three-dimensional space.

[Concretization Processing]

Figure 6:
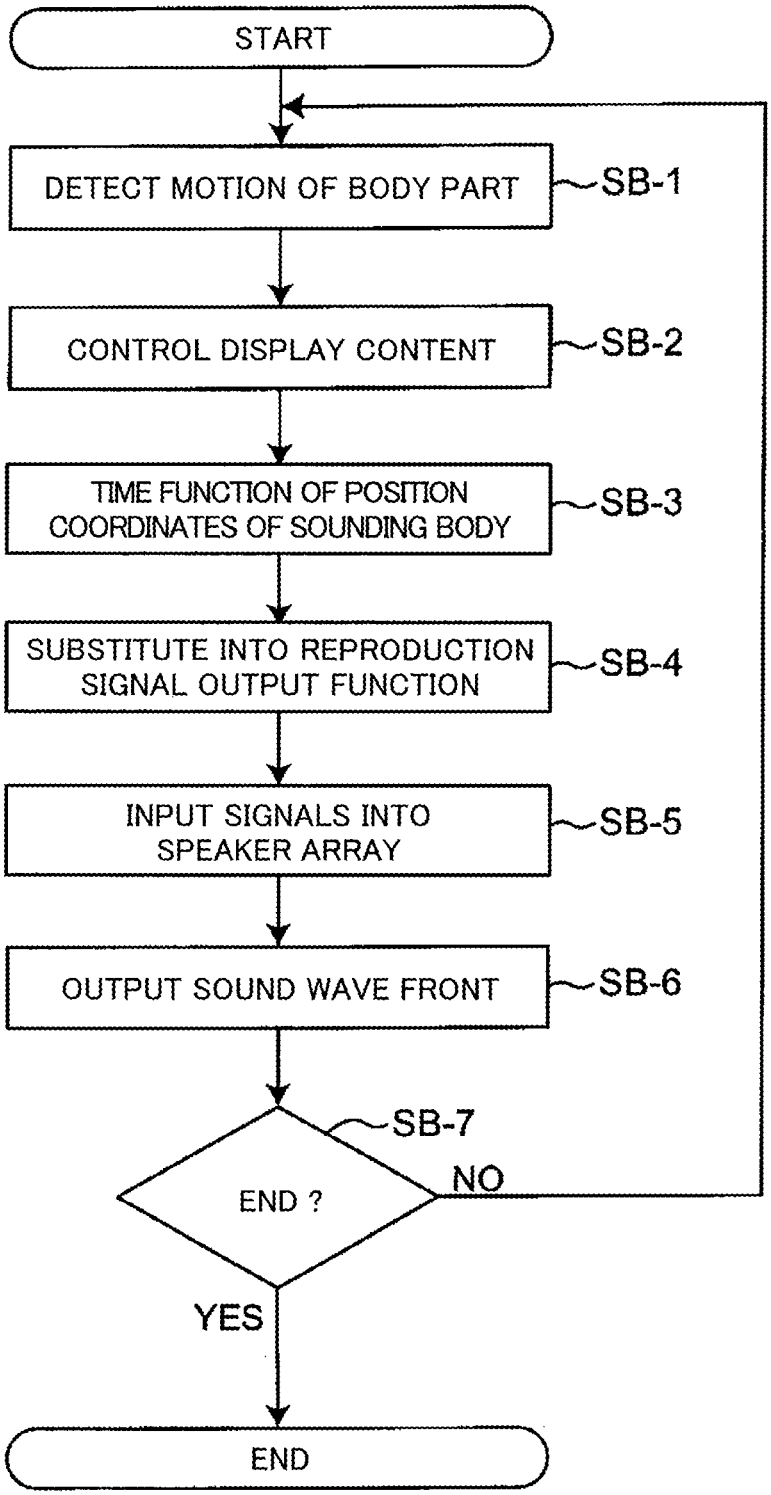
FIG. 6 is a flowchart illustrating an example of concretization processing in the spatial sound generation system of the present embodiment.
Figure 7:
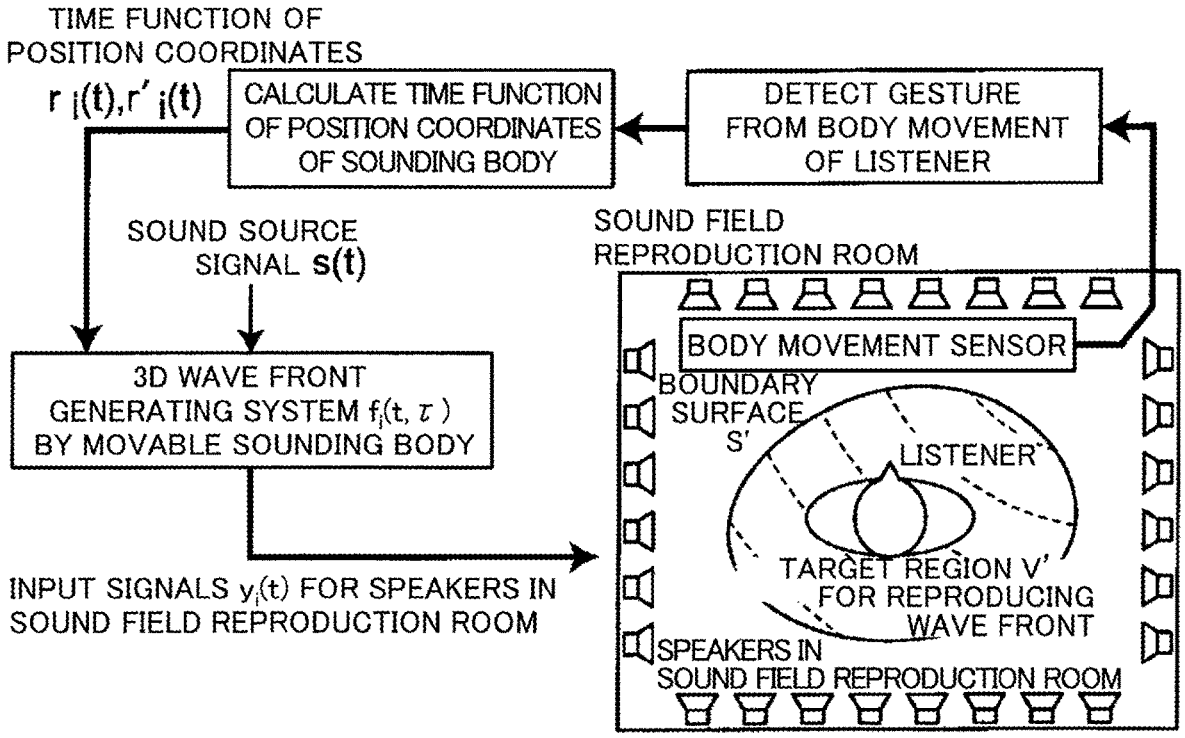
FIG. 7 is a diagram schematically illustrating a spatial sound generation algorithm based on the principle of boundary surface control (BoSC) in connection with FIG. 3.

Next, an example of the concretization processing of the spatial sound generation system in the present embodiment will be described with reference to FIG. 6 and FIG. 7. In the concretization processing, processing of changing the display contents in the body of the user and generating a sound field accompanied by a three-dimensional acoustic wave front according to the change is performed. Here, FIG. 6 is a flowchart illustrating an example of concretization processing in the spatial sound generation system of the present embodiment. FIG. 7 is a diagram schematically illustrating a spatial sound generation algorithm based on the principle of boundary surface control (BoSC) in connection with FIG. 3.

First, as illustrated in FIGS. 6 and 7, in the present spatial sound generation system, the detector 112 such as a body movement sensor recognizes the motion of the body part of the user (step SB-1). For example, from the user's body movement, the detector 112 may detect a predetermined gesture such as movement of pointing in one direction, movement of pushing hands in one direction, movement of kicking a leg in one direction, movement as if to throw a ball, movement of heading a ball, movement of catching something with both hands, or movement of wielding a baton.

Then, under the control of the display controller 102*a*, the spatial sound generation device 100 of the present spatial sound generation system performs display control of displaying the content information stored in the content file 106*b* according to the motion of the body part of the user recognized by the detector 112 via the display 114 such as a three-dimensional display HMD (step SB-2). For example, with a virtual reality space such as a game space displayed, the display controller 102*a* may perform display control of changing corresponding content elements according to a gesture such as movement of throwing a ball or the like of a user, movement of kicking or heading a ball, and movement of wielding a baton detected by the detector 112.

Then, under the control of the sound source calculator 102*b*, the spatial sound generation device 100 of the present spatial sound generation system acquires the sound source signal s(t) and the time functions of the position coordinates $r_i(t)$ and $r'_i(t)$ with the corresponding content information as the sounding body according to a change in the content information display-controlled by the display controller 102*a* (step SB-3). For example, the sound source calculator 102*b* may read the sound source signal s(t) associated with the content element being the target of the change such as movement from the content file 106*b* or the like according to the change in the content information by the display controller 102*a*, and may acquire the time functions of the position coordinates $r_i(t)$ and $r'_i(t)$ of the content information accompanying the change of the content information corresponding to the motion of the body part of the user via the detector 112.

Then, the spatial sound generation device 100 of the present spatial sound generation system substitutes the sound source signal s(t) and $r_i(t)$ and $r'_i(t)$ into the reproduction signal output function stored in the function file 106*a* under the control of the sound source calculator 102*b* (step SB-4). Here, the reproduction signal output function is a reproduction signal output function "$y_i(t)=\Sigma f_i(t, \tau')\, s(t-\tau)d\tau$" based on the inverse filtering $H^{\wedge}_{ji}(\omega)$ for cutputting an input signal $Y_i(\omega)$ (i=1 to M) from the sound pressure signal $p(r^{\wedge}_j, t)$ on the boundary surface S' of the region V' including the user's head to each speaker of the speaker array 116 and the transfer function $c(r^{\wedge}_j, t, T)$ from the position coordinates of the sounding body in the virtual three-dimensional space $r_j(t)$ (j=1 to N) to the position coordinates $r^{\wedge}_j$ of the sound pressure signal $p(r^{\wedge}_j, t)$ on the boundary surface S', and is prescribed by the formulae (41) and (42), for example.

Then, under the control of the wave front output controller 102*c*, the spatial sound generation device 100 of the present spatial sound generation system inputs the input signal $y_i(t)$ obtained by the sound source calculator 102*b* into each speaker (1 to M) of the speaker array 116 (step SB-5).

Then, the speaker array 116 of the present spatial sound generation system outputs a three-dimensional acoustic wave front by a sounding body moving in a virtual three-dimensional space with a speaker output corresponding to the input signal $y_i(t)$ (step SB-6).

Then, the spatial sound generation device 100 of the present spatial sound generation system repeats the above-described processing unless there is a termination instruction such as pressing an end button of a touch panel and the like (step SB-7, NO). The spatial sound generation device 100 terminates the processing when there is a termination instruction such as pressing an end button of a touch panel and the like (step SB-7, YES). Here, the spatial sound generation device 100 of the present spatial sound generation system may convert the reproduction system of the signal indicating the time-series acoustic wave front output formed by the above processing into another reproduction system such as a surround reproduction system by processing of the reproduction system convertor 102*d* to output the signal of the conversion result to the external device 200 or the like. At this time, the reproduction system convertor 102*d* may appropriately record the signals before and after the conversion in the storage 106.

The above is an example of the processing of the spatial sound generation system. Thus, the user such as a creator can interactively edit the contents intuitively by using the body motion such as pointing in an environment with good sound image localization accuracy. Therefore, even a user not familiar with computer engineering such as programming can easily generate a sound field having realistic sensation.

This concludes the description of the processing of the spatial sound generation system according to the present embodiment.

Example

Figure 8:
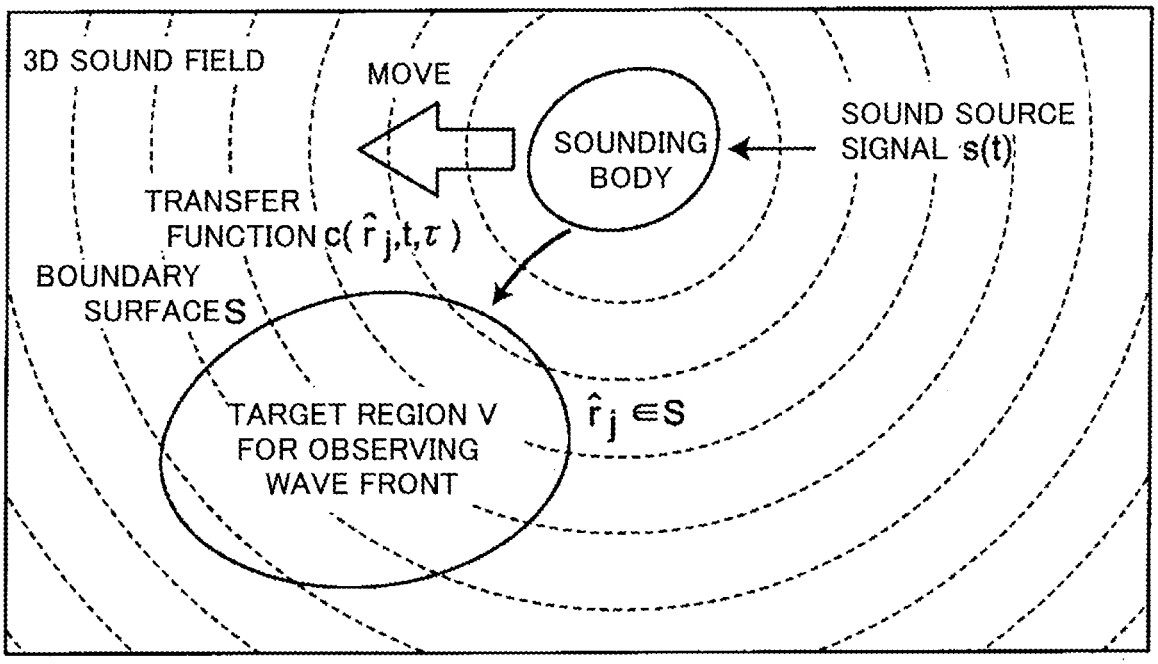
FIG. 8 is a diagram illustrating the relationship between the sounding body moving in the three-dimensional sound field and the target region V for observing wave front.
Figure 9:
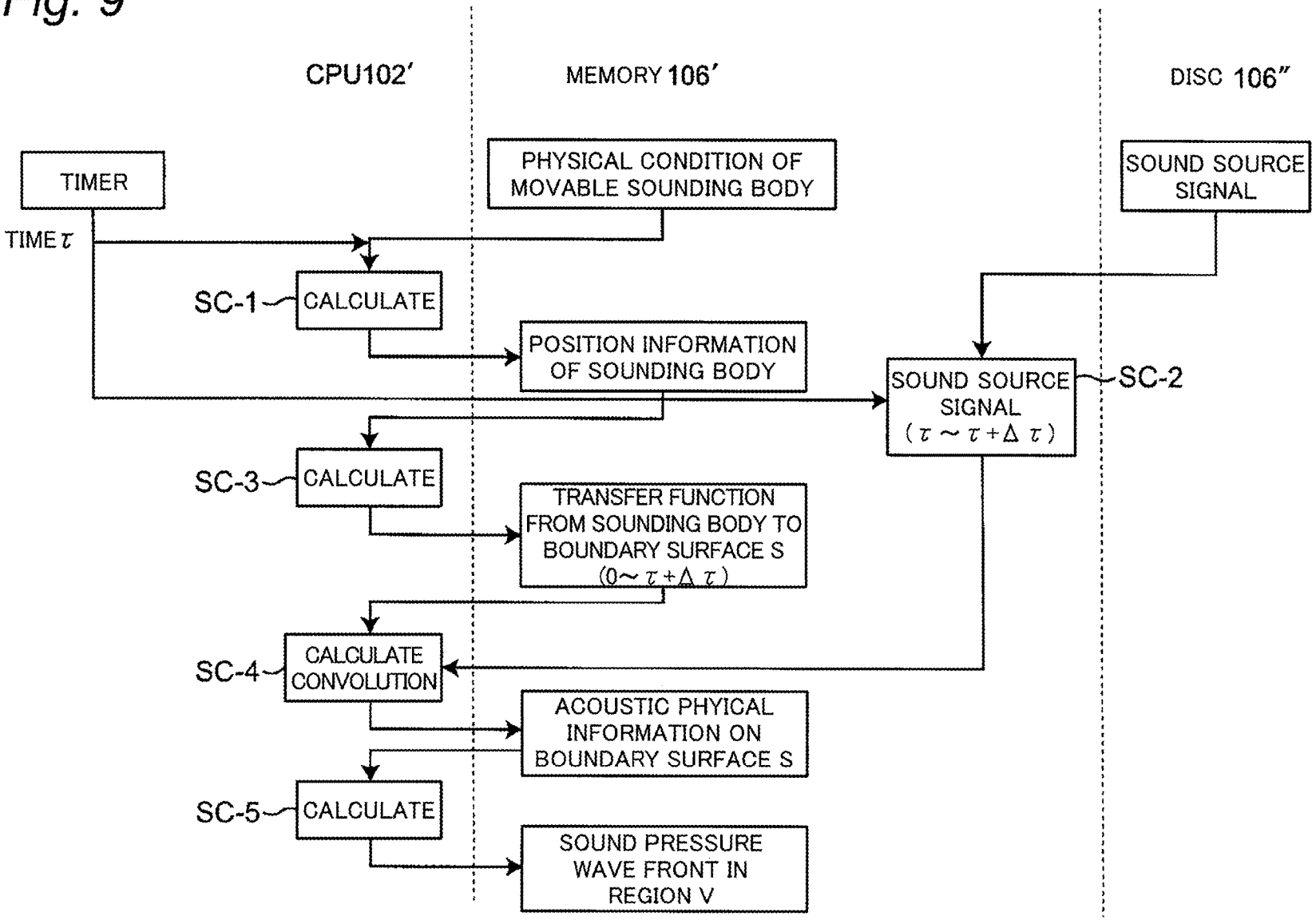
FIG. 9 is a workflow diagram illustrating processing details and stored contents in a concrete device configuration of a spatial sound generation device 100.

Then, a procedure for calculating the wave front in the region V from the physical condition and the sound source signal of the moving sounding body will be described with reference to FIGS. 8 and 9 as an example in the embodiment of the present invention. FIG. 8 is a diagram illustrating the relationship between the sounding body moving in the three-dimensional sound field and the target region V for observing the wave front. FIG. 9 is a workflow diagram illustrating processing contents and stored contents in a concrete device configuration of the spatial sound generation device 100.

As illustrated in FIGS. 8 and 9, first, the CPU 102' of the spatial sound generation device 100 obtains the positional information on the sounding body $r^{\wedge}_j$ from the physical condition of the moving sounding body stored in the memory 106' and the time of the timer τ (step SC-1).

Then, the CPU 102' of the spatial sound generation device 100 obtains a sound source signal s(ω) stored in the disk 106" and a sound source signal s(t) with respect to $t=\tau$ to $\tau+\Delta\tau$, from the time t indicated by the timer to the time after the elapse of $\Delta\tau$ (step SC-2).

Then, the CPU 102' of the spatial sound generation device 100 calculates the transfer function $c(\hat{r}_j, t, \tau)$ from the positional information on the sounding body $\hat{r}_j$ stored in the memory 106' to the boundary surface S surrounding the target region V for observing the wave front (step SC-3). For example, with respect to each time t, the CPU 102' (controller) executes numerical calculation of the boundary element method with the corresponding positional information $\hat{r}_j$ and the boundary surface S as a boundary condition, whereby the transfer function $c(\hat{r}_j, t, \tau)$ for each time t is calculated.

Then, the CPU 102' of the spatial sound generation device 100 performs convolution calculation on the transfer function $c(\hat{r}_j, t, \tau)$ from the sounding body at time 0 to $\tau$ obtained in step SC-3 to the boundary surface S based on the sound source signal s(t) at time $t=\tau$ to $\tau+\Delta\tau$, and obtains sound physical information such as the sound pressure signal $p(\hat{r}_j, t)$ on the boundary surface S (step SC-4).

Then, the CPU 102' of the spatial sound generation device 100 calculates a sound pressure wave front in the region V from sound physical information such as the sound pressure signal $p(\hat{r}_j, t)$ on the boundary surface S with the region V (step SC-5).

The above is the procedure for calculating the wave front in the region V from the physical condition and the sound source signal of the moving sounding body. In order to finally form a sound field of a three-dimensional acoustic wave front in the present embodiment by using the physical condition of the moving sounding body and the calculation of the wave front in the region V from the sound source signal as described above, it is necessary to obtain an input signal to the speaker array 116.

Figure 10:
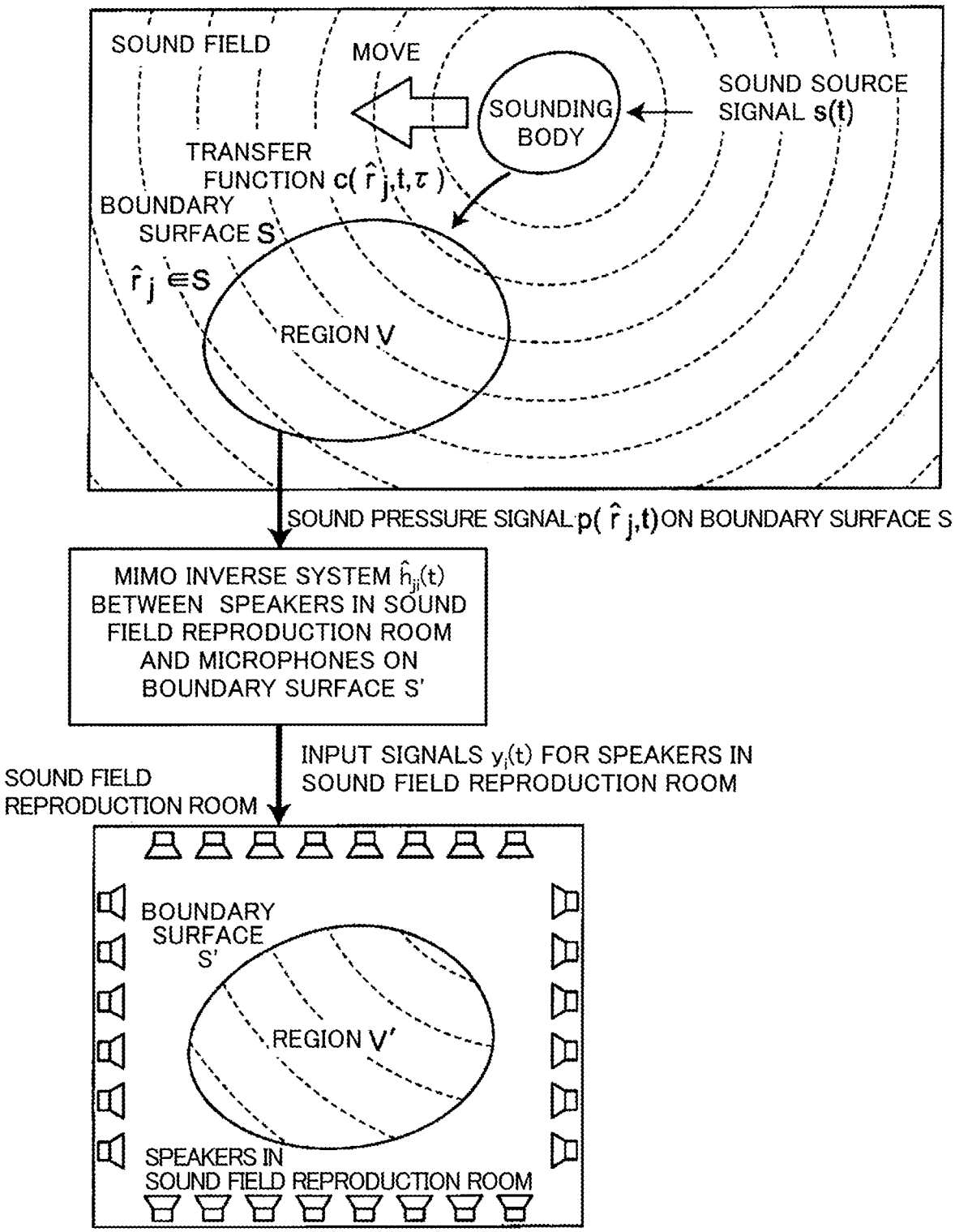
FIG. 10 is a diagram schematically illustrating that input signals to each speaker of a speaker array 116 is obtained by using a MIMO inverse filtering.
Figure 11:
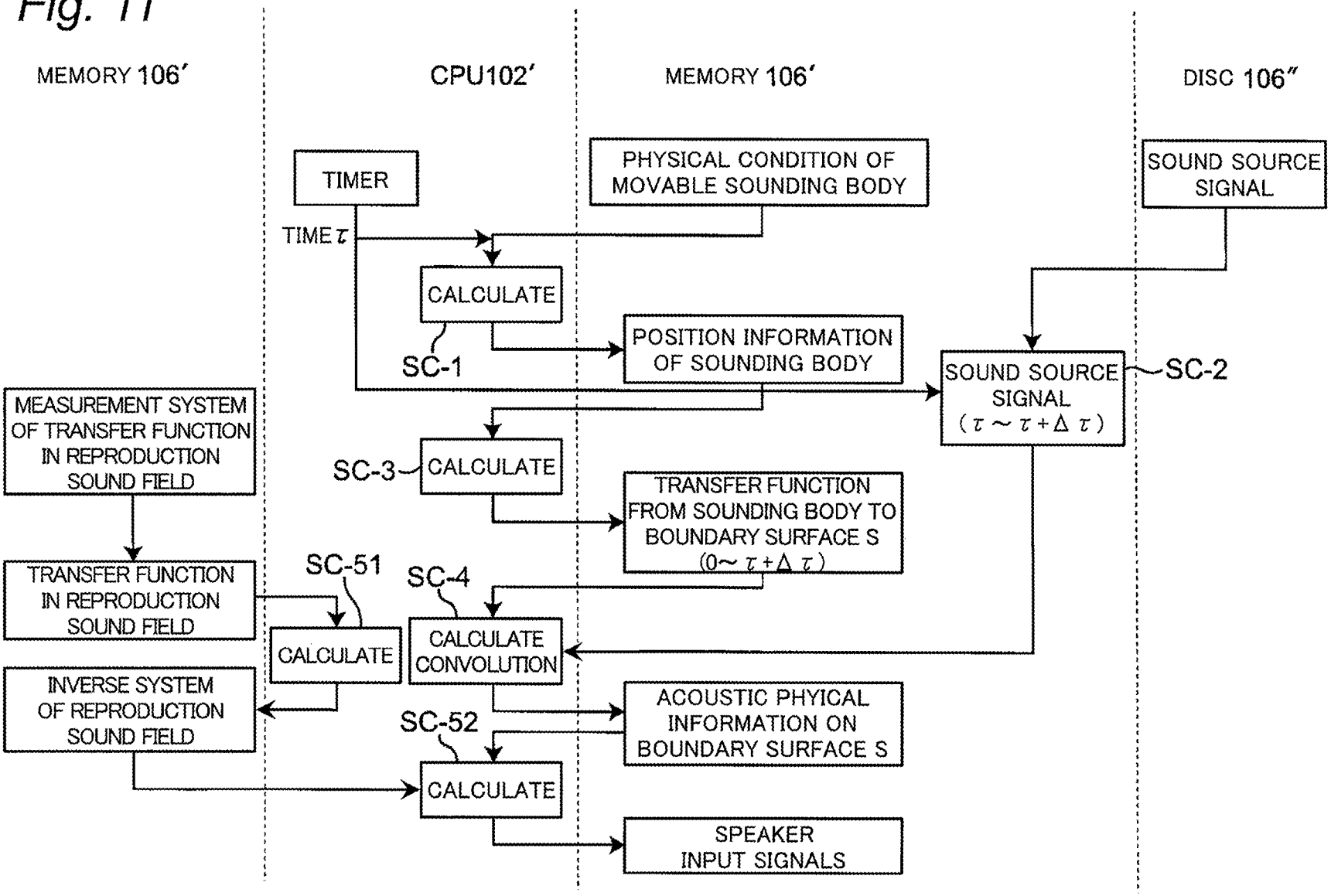
FIG. 11 is a workflow diagram illustrating processing details and stored contents in a concrete device configuration of the spatial sound generation device 100.

Therefore, then, from the physical condition of the moving sounding body, the sound source signal, and the transfer function of the reproduction sound field, an example of a procedure for calculating the speaker input signal in the sound field reproduction room will be described with reference to FIGS. 10 and 11. Here, FIG. 10 is a diagram schematically illustrating that the input signal to each speaker of the speaker array 116 is obtained by using the MIMO inverse filtering. FIG. 11 is a workflow diagram illustrating processing contents and stored contents in a concrete device configuration of the spatial sound generation device 100.

As illustrated in FIGS. 10 and 11, first, the CPU 102' of the spatial sound generation device 100 obtains the positional information on the sounding body $\hat{r}_j$ from the physical condition of the moving sounding body stored in the memory 106' and the time of the timer $\tau$ (step SC-1). Similarly, the CPU 102' of the spatial sound generation device 100 performs the processing of the above-described steps SC-1 to SC-4.

Here, in the memory 106' of the spatial sound generation device 100, a measurement system of a transfer function in the reproduction sound field is obtained based on the sound data or the like previously recorded in the reproduction sound field with a microphone array or the like, and the transfer function is obtained to be stored in the memory 106' (hereinafter, for specific methods, see JP 2011-182135 A, JP 2008-118559 A, and the like).

Then, the CPU 102' of the spatial sound generation device 100 obtains an inverse filtering of the reproduction sound field from the transfer function in the reproduction sound field stored in the memory 106' (step SC-51). Information indicating the inverse filtering of the reproduction sound field may be stored in advance in the memory 106' (storage).

Then, the CPU 102' of the spatial sound generation device 100 obtains an input signal $y_j(t)$ into each speaker of the speaker array 116 from the inverse filtering of the reproduction sound field stored in the memory 106' and the sound physical information such as the sound pressure signal $p(\hat{r}_j, t)$ on the boundary surface S (step SC-52).

The above is the procedure for calculating the speaker input signal in the sound field reproduction room from the physical condition of the moving sounding body, the sound source signal, and the transfer function of the reproduction sound field. Thus, it is possible to generate a sound field accompanied by a three-dimensional acoustic wave front having realistic sensation.

OTHER EMBODIMENTS

By the way, the embodiment of the present invention is described so far, but the present invention may be implemented even in various different embodiments other than the above-described embodiment within the scope of the technical idea described in the claims.

For example, in the above-described embodiment, the acoustic barrel-type speaker array 116 exemplified in FIG. 2 is described, but a plurality of speakers in the spatial sound generation system is not limited to those in FIG. 2, and various speakers may be used in various arrangements. A modified example of the speaker array in the spatial sound generation system will be described with reference to FIG. 12.

Figure 12:
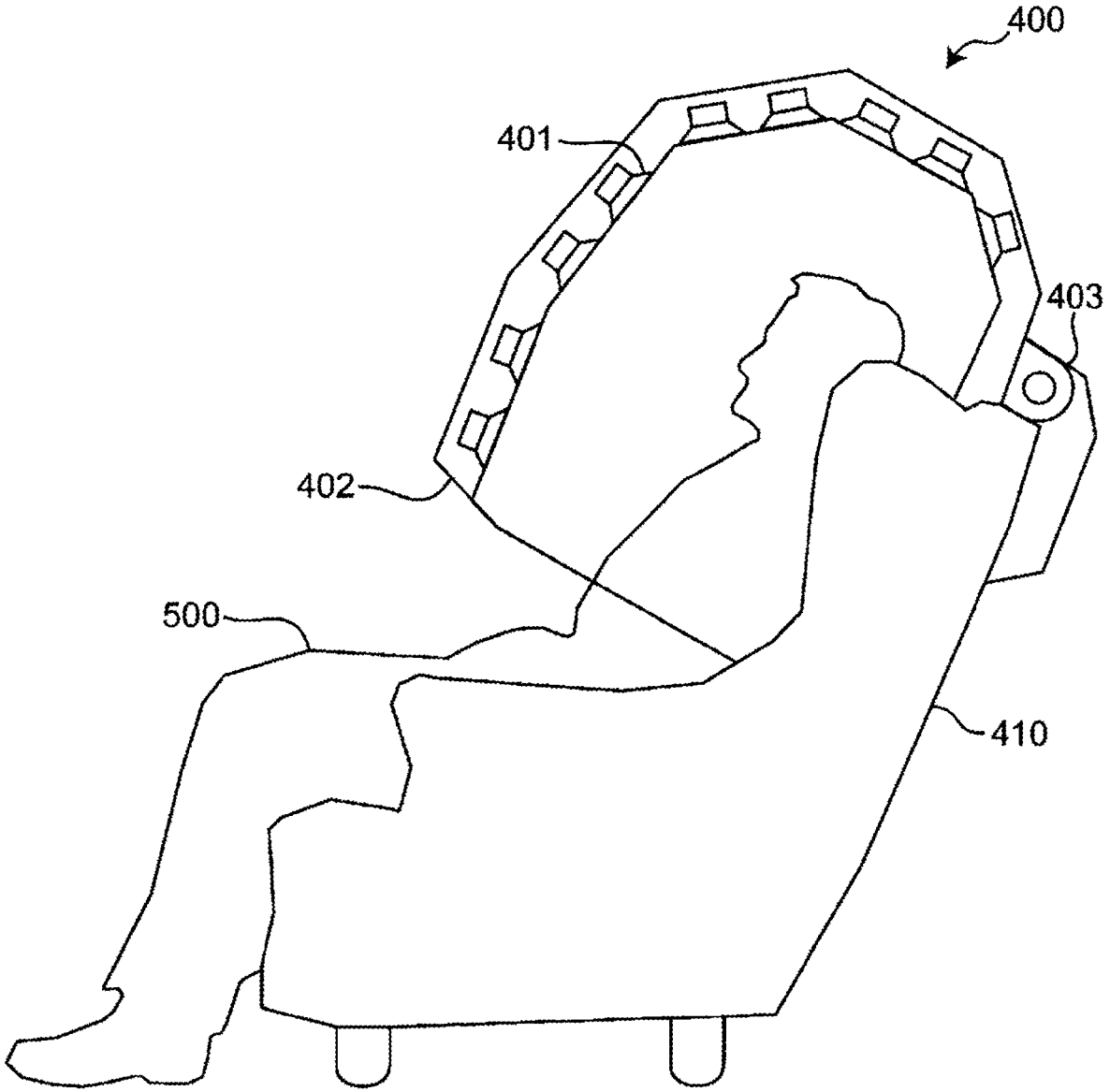
FIG. 12 is a diagram illustrating a modified example of the speaker array in the spatial sound generation system.

FIG. 12 illustrates a speaker array 400 that can be attached to a chair 410 in a spatial sound generation system. In the speaker array 400 of the present modified example, a plurality of speakers 401 are attached to the cover portion 402 to surround the head of the user 500 with the user 500 seated on the chair 410.

The plurality of speakers 401 are three-dimensionally arranged in the cover portion 402, for example, to be positioned in front of, above, and beside the user 500 seated on the chair 410. The cover portion 402 is a member formed in a dome shape so that each speaker 401 covers the head or upper body with a spacing from the user 500 seated on the chair 410. Between the cover portion 402 and the chair 410, for example, an attachment portion 403 capable of vertically moving the cover portion 402 with respect to the chair 410 is provided. Thus, the position of the cover portion 402 can be appropriately adjusted at a point of time before or after the user 500 sits on the chair 410.

According to the speaker array 400 of the example in FIG. 12, a space capable of forming various wave fronts generated by the spatial sound generation device 100 can be provided between the user 500 sitting on the chair 410 and the speaker 401. The spatial sound generation system including the speaker array 400 can be applied to various uses such as games and viewing various entertainments. The speaker array 400 of the spatial sound generation system may be provided separately from the chair 410 or may be integrally provided.

In addition, in the above-described embodiment, an example is described in which the detector 112 detects the motion of the body part of the user (gesture motion) and interlocks the detection result with the movement of the sounding body. The detection target of the detector 112 in the spatial sound generation system is not limited to the gesture motion, may be various kinds of information for interlocking the detection result of the detector 112 with the movement of the sounding body, and for example, images, vibrations, and the like may be used as detection targets of the detector 112.

For example, when a live TV broadcast of ice skating is performed, the position of the athlete in the video (sounding body) may be detected. In this case, a spatial sound generation system can be used so that for example, a sound source signal is acquired from a microphone or the like installed in a skating rink, and the running sound and the like is heard by viewers of the live TV broadcast in accordance with the movement of the athlete in the video. In addition, in experience-based games such as soccer and boxing and the like, with the vibration generated by the user and the like as the detection target, the movement of the contents of the game (sounding body) may be set according to the vibration of the detection result, and a wave front for interlocking with the set movement may be formed.

As described above, the detector 112 in the spatial sound generation system may detect information on the movement of various sounding bodies. As the detector 112 in the spatial sound generation system, an image analysis means and various sensors such as an acceleration sensor and a gyro sensor may be used.

In addition, the controller 106 of the spatial sound generation device 100 may calculate information indicating a moving sounding body such as the position of the sounding body and the sound source signal based on the information on the movement of the sounding body detected by the detector 112, or may separately acquire information indicating a moving sounding body. For example, the controller 106 may acquire information indicating the moving sounding body by reading the data or the like stored in advance in the storage 102, or may acquire the information from the outside via the network 300 or the like.

In addition, in the implementation of the spatial sound generation device 100, various pieces of calculation simplification processing can be applied. In the following, an implementation example of the spatial sound generation device 100 will be described by using an example in which the sounding body is a one point sound source moving in the free space.

In the present example, in correspondence with the physical condition of the sounding body that the position $r'(t)$ of one point sound source (size 1) moves in free space, the transfer function $c(\hat{r}_j, t, \tau)$ to the position $\hat{r}_j$ at the time t is expressed as the following formula (8).

[Math. 22]

$$c(\hat{r}_j, t, \tau) = \frac{1}{|r'(t) - \hat{r}_j|}\delta(\tau - |r'(t) - \hat{r}_j| / v_c) \tag{8}$$

In the above formula (8), $\delta(\tau)$ is the delta function, and $v_c$ is the sound velocity. Substituting the formula (8) into the above-described formula (3) allows the following formulae (9) and (10) to be obtained.

[Math. 23]

$$y_i(t) = \sum_{j=1}^{N} \int_0^{\infty} \hat{h}_{ji}(t - \tau) w_j(\tau) d\tau \tag{9}$$

-continued $$w_j(t) = \frac{1}{a_j(t)} s(t - a_j(t) / v_c) \tag{10}$$

$$a_j(t) = |r'(t) - \hat{r}_j|$$

In the above formulae (9) and (10), $w_j(t)$ denotes the sound pressure signal, and $a_j(t)$ denotes the distance between the sound source and the sound receiving point. The above formulae (9) and (10) are expressed as the following formulae (11) and (12) by discretizing the formulae (9) and (10) at the sampling frequency $F_s$ (Hz).

[Math. 24]

$$y_i[k] = \sum_{j=1}^{N} \sum_{n=0}^{L-1} \hat{h}_{ji}[k - n] w_j[n] \tag{11}$$

$$w_j[n] = \frac{1}{a_j[n]} s[n - a_j[n] F_s / v_c] \tag{12}$$

$W_j[n]$ in the above formulae (11) and (12) is a time signal that changes in amplitude and extends in time according to the distance $a_j[n]$ between the sound source and the sound receiving point at discrete time n, and includes also the Doppler effect when the distance between the sound source and the sound receiving point rapidly changes.

Incidentally, the sample point $(n-a_j[n]F_s/v_c)$ of $s[n-a_j[n]F_s/v_c]$ on the right side of the above formula (12) is a real number. With respect to the value of the sound source signal $s[n-a_j[n]F_s/v_c]$ at such a real number sample point, Non-Patent Document 3 proposes a method of calculating by a Lagrange interpolation method or the like. However, according to the conventional method as described above, there is a problem that calculation cost is increased.

Thus, in the present implementation example, instead of interpolating $s[n-a_j[n]F_s/v_c]$ in formula (12), the method of rounding off decimal places of the sample point $(n-a_j[n]F_s/v_c)$ is adopted. According to the present method, the formula (12) is calculated as the following formula (13).

[Math. 25]

$$w_j[n] = \frac{1}{a_j[n]} s[\mathrm{round}(n - a_j[n] F_s / v_c)] \tag{13}$$

In accordance with the above formula (13), the controller 106 of the spatial sound generation device 100 performs rounding processing on the sample point $(n-a_j[n]F_s/v_c)$ having a delay corresponding to the movement of the sounding body by a round function. The controller 106 calculates an input signal $y_i(t)$ into the speaker from the sound source signal of a result of the rounding processing, for example, by frame processing described below. Thus, the calculation cost at the time of obtaining the input signal $y_i(t)$ for reproducing the moving sound source can be reduced. An example of frame processing based on the above formula (13) will be described below.

The distance $a_j[n]$ in formula (13) varies for each sample in accordance with the movement of the sound source (sounding body), and in frame processing, linear interpolation can be used for distance calculation. For example, regarding a sound source whose moving speed is sufficiently lower than the sound speed, it is considered that the distance $a_j[n]$ varies linearly during a certain frame section.

In the frame processing of the present implementation example, the calculation of the distance $a_j[n]$ based on the position of the sounding body is performed with reference to the beginning of each frame, and the distance is considered to linearly vary at each sample position up to the beginning of the next frame. In this case, the distance $a_j[m, k]$ of the sample number k within one frame in the frame number m is expressed as the following formula (14).

[Math. 26]

$$a_j[m,k]-\beta([k]a_j[m,1]+(1-\beta[k])a_j[m+1,1] \tag{14}$$

In the above formula (14), "n" corresponding to $a_j[m, k]-a_j[n]$ is $n=(m-1)\times L+k$ using the number of samples L for one frame, and $\beta[k]=(L-k)/(L-1)$. Formula (13) can be expressed as

[Math. 27]

$$w_j[m, k] = \frac{1}{a_j[m, k]} s[\text{round}(n - a_j[m, k]F_s / v_c)] \tag{15}$$

by frame processing.

In the present implementation example, in frame processing, the controller 106 of the spatial sound generation device 100 calculates the distance $a_j[m, 1]$ between the sound source and the sound receiving point for each frame section L, and calculates the signal $w_j[m, k]$ of the moving sound source in the frame from formula (15). Based on the calculated signal $w_j[m, k]$, the controller 106 obtains the input signal $y_i[n]$ into the speaker by convolving the inverse filter by using formula (11).

According to the above processing, it is possible to obtain the input signal $y_i[n]$ into the speaker without causing noise for each frame as assumed when convolution is performed on a moving sound source by a known OverLap Add method, for example. In addition, the algorithm of the above processing is simpler than that of the above-described method, and the calculation cost can be reduced. Furthermore, the above processing can cope even with the Doppler effect according to the moving speed of the sound source.

In the above description, the example in which the sounding body is a single point sound source is described. Even when the sounding body is a plurality of point sound sources, calculating formula (10) for each point sound source to superpose the calculated results and convolving the inverse filter by using formula (11) allows the input signal $y_i[n]$ into the speaker to be obtained. In addition, even when the sounding body has a vibrating surface or a non-vibrating surface, approximately representing the sounding body as aggregation of point sound sources allows the input signal $y_i[n]$ into the speaker to be obtained in the same manner as above.

In addition, in the above description, an example of applying an inverse filtering to the signal of the moving sound source $w_j[m, k]$ obtained by the processing of the implementation example and obtaining the input signal $y_i[n]$ into the speaker under the boundary surface control is described. The above processing is not limited to the boundary surface control, and can be applied to various reproduction systems such as the wave front synthesis (WFS) system, the 2ch stereo system, and the binaural system. Thus, the calculation cost at the time of generating input signals into various speakers and headphones for reproducing moving sound sources can be reduced.

In addition, in the spatial sound generation device 100, the detector 112, the display 114, the speaker array 116, and the like are illustrated as separate housings, but the present invention is not limited to this, and they may be configured with the same housing.

In addition, the spatial sound generation device 100 may perform processing in response to a request from a client terminal such as the external device 200, and may return the processing result to the client terminal.

In addition, among the respective pieces of the processing described in the embodiments, all or a part of pieces of the processing described as being performed automatically can be performed manually, or all or a part of pieces of the processing described as being performed manually can be performed automatically by a known method.

In addition, the processing procedure, the control procedure, the specific names, the information including parameters such as registration data and search conditions of each piece of the processing, the screen examples, and the database configuration illustrated in the above documents and in the drawings can be arbitrarily changed unless otherwise noted.

In addition, regarding the spatial sound generation device 100, the external apparatus 200, and the like, the respective components illustrated in the drawings are functionally conceptual, and do not necessarily have to be physically configured as illustrated.

For example, regarding the processing functions included in each device of the spatial sound generation device 100 and particularly each processing function performed by the controller 102, all or any part thereof may be achieved with a processor such as a central processing unit (CPU) and a program interpreted and executed by the processor and may be achieved as a hardware processor based on wired logic. It should be noted that the program is recorded in a non-transitory computer-readable recording medium including a programmed instruction for causing the computer to execute the method according to the present invention, which will be described below, and is mechanically read by the spatial sound generation device 100 and the external apparatus 200. That is, in the storage 106 such as a ROM or a hard disk drive (HDD) and the like, a computer program for giving instructions to the CPU in cooperation with the operating system (OS) and performing various pieces of processing is recorded. This computer program is executed by being loaded into the RAM, and cooperates with the CPU to constitute a controller.

In addition, this computer program may be stored in an application program server connected to the spatial sound generation device 100 or the external apparatus 200 via an arbitrary network 300, and all or a part thereof may also be downloaded as necessary.

In addition, the program according to the present invention may be stored in a computer-readable recording medium, and may be configured as a program product. Here, the "recording medium" includes any "portable physical medium" such as a memory card, a USB memory, an SD card, a flexible disk, a magneto-optical disk, a RON, an EPROM, an EEPROM, a CD-ROM, an MO, a DVD, or a Blu-ray (registered trademark) Disc.

In addition, the "program" is a data processing method described in any language and description method, and any form of source code, binary code, and the like can be used. It should be noted that the "program" is not necessarily limited to those singly configured, and includes also those distributedly configured as a plurality of modules or libraries and those for achieving the function in cooperation with a separate program represented by an OS. It should be noted that well-known configurations and procedures can be used for specific configurations for reading the recording medium, reading procedures, installation procedures after reading, or the like in the respective devices described in the embodiments. The present invention may be configured as a program product recorded in a non-transitory computer-readable recording medium.

Various databases and the like stored in the storage 106 (function file 106*a*, content file 106*b*, and the like) are storage means such as a memory device such as a RAM and ROM, a fixed disk device such as a hard disk, a flexible disk, and an optical disk, and store various programs, tables, databases, files for web pages, and the like used for various pieces of processing and providing websites.

In addition, the spatial sound generation device 100, the external apparatus 200, the detector 112, the display 114, and the speaker array 116 may be configured as information processing devices such as known personal computers and workstations, and any peripheral device may be connected to the information processing devices. In addition, the spatial sound generation device 100, the external apparatus 200, the detector 112, the display 114, and the like may be achieved by implementing software (including programs, data, and the like) for causing the information processing devices to achieve the method of the present invention.

Furthermore, specific forms of distribution and/or integration of the device are not limited to those illustrated in the drawings, and all or a part of them may be configured functionally or physically distributed and/or integrated in any units according to various additions or the like, or according to functional loads. That is, the above-described embodiments may be arbitrarily combined with each other, or embodiments may be selectively performed. Hereinafter, aspects according to the present invention will be exemplified.

A first aspect according to the present invention is a spatial sound generation device including a storage and a controller, the spatial sound generation device connected to a plurality of speakers. Referring to information indicating a movable sounding body, the controller varies a transfer characteristic for each time in accordance with movement of the sounding body and applies an inverse filtering to calculate a plurality of input signals for the respective speakers from a sound source signal indicating a sound emitted by the sounding body. The inverse filtering outputs the input signals into the speakers to form a three-dimensional acoustic wave front under boundary surface control in accordance with a transfer characteristic for a space in which the plurality of speakers are arranged.

In the second aspect, in the spatial sound generation device of the first aspect, the storage stores a reproduction signal output function prescribed by a transfer function and the inverse filtering, the transfer function indicating a time-varying transfer characteristic from position coordinates of the sounding body in a virtual three-dimensional space to a boundary of a region as an observation target of sound pressure. The information indicating the movable sounding body includes a sound source signal of the sounding body in the virtual three-dimensional space and a time function of the position coordinates. The controller inputs a sound source signal of the sounding body and a time function of the position coordinates into the reproduction signal output function to derive the input signals.

In a third aspect, in the spatial sound generation device of the first aspect, the information indicating the movable sounding body includes a time function of position coordinates of the sounding body in a virtual three-dimensional space and a sound source signal of the sounding body. The controller calculates a transfer function indicating a time-varying transfer characteristic from position coordinates of the sounding body to a boundary of a region as an observation target of sound pressure based on a time function of the position coordinates, and calculates the input signals from the sound source signal based on the transfer function and the inverse filtering.

In a fourth aspect, in the spatial sound generation device of the second or third aspect, the controller calculates the time function of the position coordinates based on a relative positional relationship between the sounding body and a user in the virtual three-dimensional space.

In a fifth aspect, in the spatial sound generation device of the fourth aspect, the spatial sound generation device further includes a display. The controller controls the display to display the sounding body in the virtual three-dimensional space.

In a sixth aspect, in the spatial sound generation device of the fifth aspect, the spatial sound generation device further includes a body sonic transducer. The controller controls the body sonic transducer to vibrate a user according to content information.

In a seventh aspect, in any one of the second to sixth spatial sound generation devices, the controller calculates a reproduction acoustic wave front signal for reproducing a Doppler shift according to a speed of a sounding body and/or a user in the virtual three-dimensional space.

In an eighth aspect, in any one of the second to seventh spatial sound generation devices, the spatial sound generation device is further connected to a detector configured to detect information on movement of the sounding body. The controller calculates at least one of the sound source signal of the sounding body and the time function of the position coordinates based on a detection result of the detector.

In a ninth aspect, in the eighth spatial sound generation device, the detector detects a motion of at least one body part of a user. The controller calculates the sound source signal of the sounding body and the time function of the position coordinates according to a motion of the body part to be detected by the detector.

In a tenth aspect, in the ninth spatial sound generation device, the controller includes a display controller configured to control display of content information according to a motion of the body part detected by the detector. The display controller may control the display of the components of the spatial sound generation device or may control the display of the external configuration connected to the spatial sound generation device. The controller calculates the sound source signal of the corresponding sounding body and the time function of the position coordinates in accordance with a change in the content information corresponding to a motion of the body part.

In an eleventh aspect, in the tenth spatial sound generation device, the detector detects a motion of a finger of the user. The display controller performs display control accompanied by movement of the content information instructed by a motion of the finger to be detected by the detector.

In a twelfth aspect, in the tenth or eleventh spatial sound generation device, the display controller performs a three-dimensional display control of the content information in the virtual three-dimensional space by controlling a head mounted display which is an example of the display.

In a thirteenth aspect, in any one of the first to twelfth spatial sound generation devices, the controller includes a reproduction system converter configured to convert a reproduction system in a signal indicating the formed acoustic wave front.

In a fourteenth aspect, in any one of the first to thirteenth spatial sound generation devices, according to movement of the sounding body, the controller performs rounding processing on the sound source signal to calculate the input signals from a sound source signal of a result of rounding processing.

A fifteenth aspect is a spatial sound generation system including a plurality of speakers, a storage, and a controller. Referring to information indicating a movable sounding body, the controller varies a transfer characteristic for each time in accordance with movement of the sounding body and applies an inverse filtering to calculate a plurality of input signals for the respective speakers from a sound source signal indicating a sound emitted by the sounding body. The inverse filtering outputs the input signals into the speakers to form a three-dimensional acoustic wave front under boundary surface control in accordance with a transfer characteristic for a space in which the plurality of speakers are arranged.

A sixteenth aspect is a spatial sound generation method to be executed in a computer connected to a plurality of speakers, the computer including a storage and a controller. The present method includes a step of the controller, referring to information indicating a movable sounding body, varying a transfer characteristic for each time in accordance with movement of the sounding body and applying an inverse filtering to calculate a plurality of input signals for the respective speakers from a sound source signal indicating a sound emitted by the sounding body. The inverse filtering outputs the input signals into the speakers to form a three-dimensional acoustic wave front under boundary surface control in accordance with a transfer characteristic for a space in which the plurality of speakers are arranged. The present method includes a step of the controller controlling respective speakers based on the input signals.

A seventeenth aspect is a spatial sound generation program for causing a computer to execute, the computer including a storage and a controller, the computer connected to a plurality of speakers. The present program causes the controller to execute a step of, referring to information indicating a movable sounding body, varying a transfer characteristic for each time in accordance with movement of the sounding body and applying an inverse filtering to calculate a plurality of input signals into the respective speakers from a sound source signal indicating a sound emitted by the sounding body. The inverse filtering outputs the input signals according to a transfer characteristic for a space in which the plurality of speakers are arranged. The present program causes the controller to execute a step of controlling respective speakers based on the input signals.

INDUSTRIAL APPLICABILITY

As described above in detail, according to the present invention, in a virtual three-dimensional space, even when contents or the like can be freely moved, a spatial sound generation device, a spatial sound generation system, a spatial sound generation method, a spatial sound generation program, and a recording medium capable of generating a sound field accompanied by a three-dimensional acoustic wave front with realism can be provided. For example, under an environment with good sound image localization accuracy, even a creator or the like not familiar with computer engineering can change the arrangement or the like of each sound source while easily manipulating the contents with pointing or the like, so that the present invention is useful in various industrial fields such as game industry and contents industry.

The invention claimed is:

1. A spatial sound generation device connected to a plurality of speakers, the spatial sound generation device comprising:

a storage; and a controller, wherein, referring to information indicating a movable sounding body, the controller calculates an acoustic transfer characteristic from the sounding body to a boundary of a region where sound receiving points exist for each time in accordance with movement of the sounding body and applies to the acoustic transfer characteristic an inverse filtering that outputs input signals into the speakers to form a three-dimensional acoustic wave front of boundary surface control in accordance with a transfer characteristic for a space in which the plurality of speakers are arranged.

2. The spatial sound generation device according to claim 1, wherein the storage stores a reproduction signal output function prescribed by an acoustic transfer function and the inverse filtering, the acoustic transfer function indicating a time-varying acoustic transfer characteristic from position coordinates of the sounding body in a virtual three-dimensional space to a boundary of a region as an observation target of sound pressure, the information indicating the movable sounding body includes a sound source signal of the sounding body in the virtual three-dimensional space and a time function of the position coordinates, and the controller inputs a sound source signal of the sounding body and a time function of the position coordinates into the reproduction signal output function to derive the input signals.

3. The spatial sound generation device according to claim 1, wherein the information indicating the movable sounding body includes a time function of position coordinates of the sounding body in a virtual three-dimensional space and a sound source signal of the sounding body, and the controller calculates the acoustic transfer function based on a time function of the position coordinates, and calculates the input signals from the sound source signal based on the acoustic transfer function and the inverse filtering.

4. The spatial sound generation device according to claim 3, wherein the controller calculates the time function of the position coordinates based on a relative positional relationship between the sounding body and a user in the virtual three-dimensional space.

5. The spatial sound generation device according to claim 4, further comprising a display, wherein the controller controls the display to display the sounding body in the virtual three-dimensional space.

6. The spatial sound generation device according to claim 5, further comprising a body sonic transducer, wherein the controller controls the transducer to vibrate a user according to content information.

7. The spatial sound generation device according to claim 2, wherein the controller calculates a reproduction acoustic wave front signal for reproducing a Doppler shift according to a speed of the sounding body and/or a user in the virtual three-dimensional space.

8. The spatial sound generation device according to claim 2, wherein the spatial sound generation device is further connected to a detector configured to detect information on movement of the sounding body, and the controller calculates at least one of the sound source signal of the sounding body and the time function of the position coordinates based on a detection result of the detector.

9. The spatial sound generation device according to claim 8, wherein the detector detects a motion of at least one body part of a user, and the controller calculates the sound source signal of the sounding body and the time function of the position coordinates according to a motion of the body part detected by the detector.

10. The spatial sound generation device according to claim 9, wherein the controller includes a display controller configured to control display of content information according to a motion of the body part detected by the detector, and calculates the sound source signal of the corresponding sounding body and the time function of the position coordinates in accordance with a change in the content information corresponding to a motion of the body part.

11. The spatial sound generation device according to claim 10, wherein the detector detects a motion of a finger of the user, and the display controller performs display control for movement of the content information instructed by a motion of the finger detected by the detector.

12. The spatial sound generation device according to claim 10, wherein the display controller performs a three-dimensional display control of the content information in the virtual three-dimensional space by controlling a head mounted display.

13. The spatial sound generation device according to claim 1, wherein the controller includes a reproduction system converter configured to convert a reproduction system in a signal indicating the formed acoustic wave front.

14. The spatial sound generation device according to claim 1, wherein according to movement of the sounding body, the controller performs rounding processing on the sound source signal to calculate the input signals from a sound source signal of a result of rounding processing.

15. A spatial sound generation system comprising:

a plurality of speakers;

a storage; and a controller, wherein, referring to information indicating a movable sounding body, the controller calculates an acoustic transfer characteristic from the sounding body to a boundary of a region where sound receiving points exist for each time in accordance with movement of the sounding body and applies to the acoustic transfer characteristic an inverse filtering that outputs input signals into the speakers to form a three-dimensional acoustic wave front of boundary surface control in accordance with a transfer characteristic for a space in which the plurality of speakers are arranged.

16. A spatial sound generation method to be executed in a computer connected to a plurality of speakers, the computer including a storage and a controller, the spatial sound generation method for causing the controller to execute:

referring to information indicating a movable sounding body, calculating an acoustic transfer characteristic from the sounding body to a boundary of a region where sound receiving points exist for each time in accordance with movement of the sounding body and applying to the acoustic transfer characteristic an inverse filtering that outputs the input signals into the speakers to form a three-dimensional acoustic wave front of boundary surface control in accordance with a transfer characteristic for a space in which the plurality of speakers are arranged; and controlling respective speakers based on the input signals.

17. A non-transitory computer-readable recording medium storing a spatial sound generation program for causing a computer connected to a plurality of speakers, the computer including a storage and a controller, to execute to cause the controller to execute:

referring to information indicating a movable sounding body, calculating an acoustic transfer characteristic from the sounding body to a boundary of a region where sound receiving points exist for each time in accordance with movement of the sounding body and applying to the acoustic transfer characteristic an inverse filtering that outputs the input signals into the speakers to form a three-dimensional acoustic wave front of boundary surface control in accordance with a transfer characteristic for a space in which the plurality of speakers are arranged; and controlling respective speakers based on the input signals.

18. A spatial sound generation device to be connected to a plurality of speakers that are arranged in a space, comprising:

a controller, wherein referring to real time position information indicating a movable sounding body, the controller outputs in real time an acoustic transfer characteristic from the sounding body, which exists at the position shown by the position information, to a boundary of a region, in the space, where sound receiving points exist and applies to the acoustic transfer characteristic an inverse filtering that outputs input signals into the speakers to form a three-dimensional acoustic wave front of boundary surface control of the space.

19. The spatial sound generation device according to claim 18, further comprising a storage which stores a reproduction signal output function prescribed by an acoustic transfer function indicating the acoustic transfer characteristic from a position of the sounding body in a virtual three-dimensional space to a boundary of a region as an observation target of sound pressure.

20. The spatial sound generation device according to claim 19, wherein the controller further inputs a sound source signal of the sounding body to derive the input signals into the speakers to form a three-dimensional acoustic wave front of boundary surface control of the space.

21. A spatial sound generation method to be executed in a computer to be connected to a plurality of speakers that are arranged in a space, the computer including a controller, the spatial sound generation method for causing the controller to execute:

referring to real time position information indicating a movable sounding body, outputting in real time an acoustic transfer characteristic from the sounding body, which exists at the position shown by the position information, to a boundary of a region, in the space, where sound receiving points exist and applying to the acoustic transfer characteristic an inverse filtering that outputs input signals into the speakers to form a three-dimensional acoustic wave front of boundary surface control of the space.

22. A non-transitory computer-readable recording medium storing a spatial sound generation program for causing a computer, which is to be connected to a plurality of speakers that are arranged in a space, the computer including a controller, to execute to cause the controller to execute:

referring to real time position information indicating a movable sounding body, outputting in real time an acoustic transfer characteristic from the sounding body, which exists at the position shown by the position information, to a boundary of a region, in the space, where sound receiving points exist and applying to the acoustic transfer characteristic an inverse filtering that outputs input signals into the speakers to form a three-dimensional acoustic wave front of boundary surface control of the space.

* * * * *